US010995947B2

(12) United States Patent
Han et al.

(10) Patent No.: US 10,995,947 B2
(45) Date of Patent: May 4, 2021

(54) AUTO-IGNITION UNIT FOR CANDLES AND CANDLES CONTAINING THEREOF

(71) Applicant: Samyoung Machinery Co., Ltd., Gongju (KR)

(72) Inventors: Kuk Hyun Han, Daejeon (KR); Yea Won Shim, Daejeon (KR); Ji Ho Kim, Daejeon (KR); Kyung Hwa Ji, Daejeon (KR)

(73) Assignee: SAMYOUNG MACHINERY CO., LTD., Gongju-si (KR)

( * ) Notice: Subject to any disclaimer, the term of this patent is extended or adjusted under 35 U.S.C. 154(b) by 579 days.

(21) Appl. No.: 15/381,458

(22) Filed: Dec. 16, 2016

(65) Prior Publication Data

US 2018/0038587 A1 Feb. 8, 2018

(30) Foreign Application Priority Data

Aug. 4, 2016 (KR) ..... 10-2016-0099694

(51) Int. Cl.

| | |
|---|---|
| ***F23D 3/16*** | (2006.01) |
| ***C11C 5/00*** | (2006.01) |
| ***F23D 3/18*** | (2006.01) |
| ***F23Q 3/00*** | (2006.01) |
| ***F23Q 21/00*** | (2006.01) |

(52) U.S. Cl.

CPC ..... *F23D 3/16* (2013.01); *C11C 5/006* (2013.01); *F23D 3/18* (2013.01); *F23Q 3/00* (2013.01); *F23Q 21/00* (2013.01); *F23D 2207/00* (2013.01)

(58) Field of Classification Search

CPC . F21V 35/00; F21V 37/00; F23D 3/16; F23D 3/24; F23D 3/18

USPC ..... 431/267–277, 288–325

See application file for complete search history.

(56) References Cited

U.S. PATENT DOCUMENTS

| | | | | |
|---|---|---|---|---|
| 6,186,776 | B1 * | 2/2001 | Myerchin | F23D 3/16 431/287 |
| 7,063,526 | B2 * | 6/2006 | Ham | F21S 13/00 431/253 |
| 2002/0119413 | A1 * | 8/2002 | Cheng | A63J 17/00 431/289 |
| 2007/0154857 | A1 * | 7/2007 | Cho | C11C 5/008 431/253 |
| 2011/0024945 | A1 * | 2/2011 | Decker | F23D 3/08 264/279 |
| 2012/0148966 | A1 | 6/2012 | Ramaker et al. | |
| 2017/0268775 | A1 * | 9/2017 | Lev | C11C 5/00 |

* cited by examiner

*Primary Examiner* — Vivek K Shirsat

(74) *Attorney, Agent, or Firm* — STIP Law Group, LLC

(57) ABSTRACT

Provided is an auto-ignition unit for a candle including a wick containing a conductive material, wherein the wick is ignited by a discharge (electric discharge). Further, provided is a candle containing the auto-ignition unit for a candle to thereby be automatically ignited by an electric signal.

38 Claims, 9 Drawing Sheets

【FIG. 1】
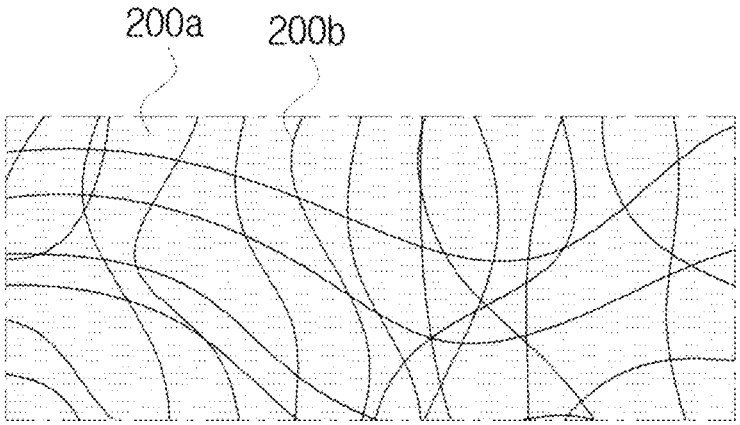
【FIG. 2】
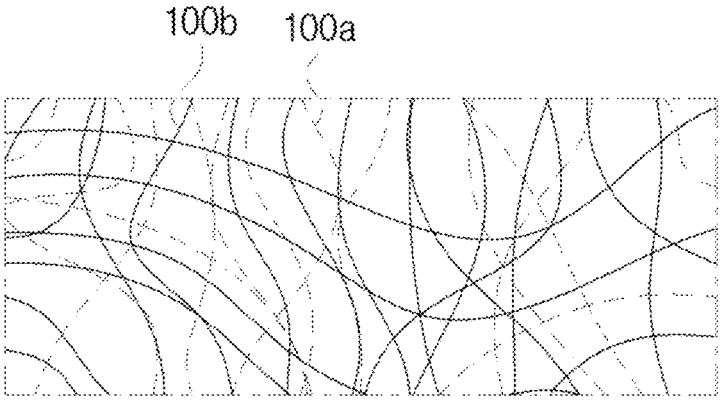
【FIG. 3】
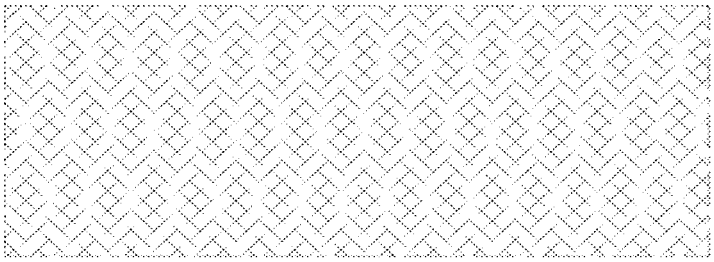

【FIG. 4】
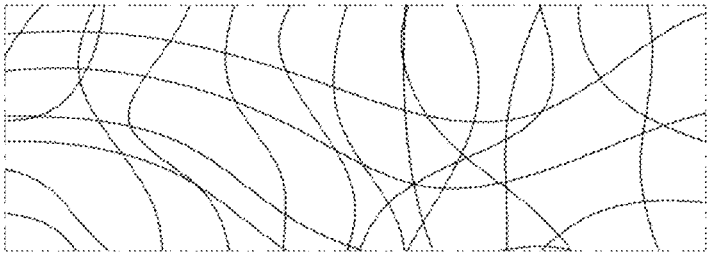
【FIG. 5】
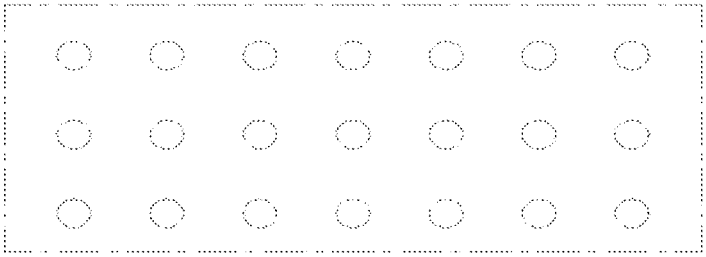
【FIG. 6】
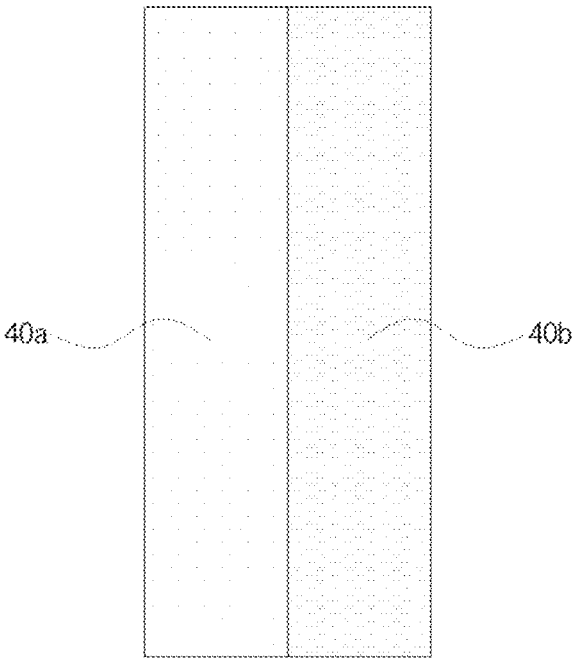

【FIG. 7】
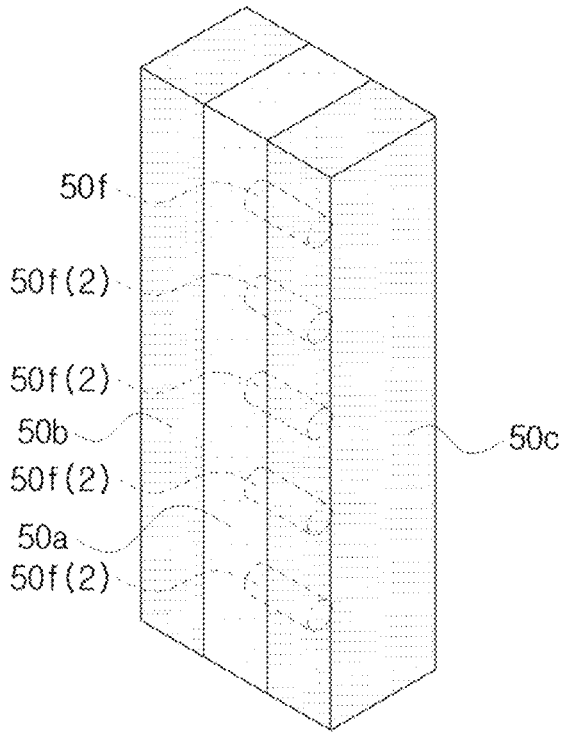
【FIG. 8】
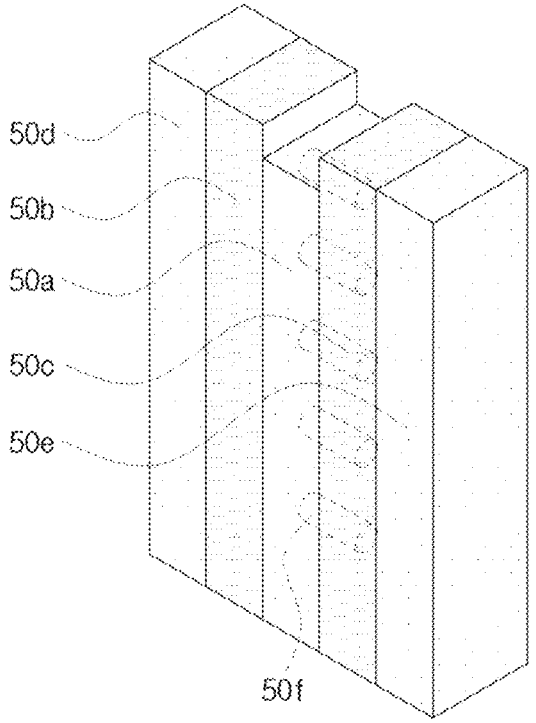

【FIG. 9】
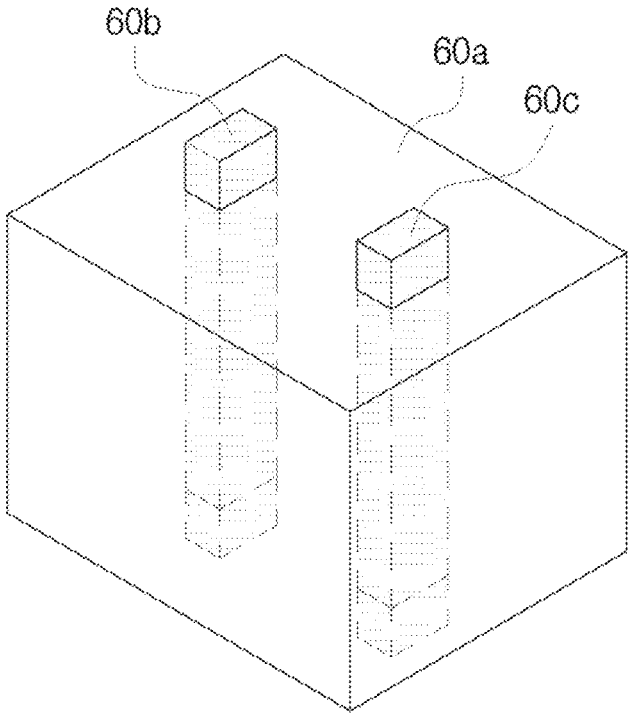
【FIG. 10】
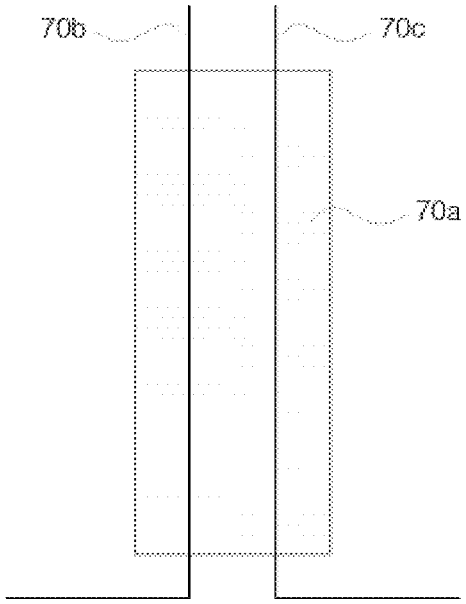

【FIG. 11】
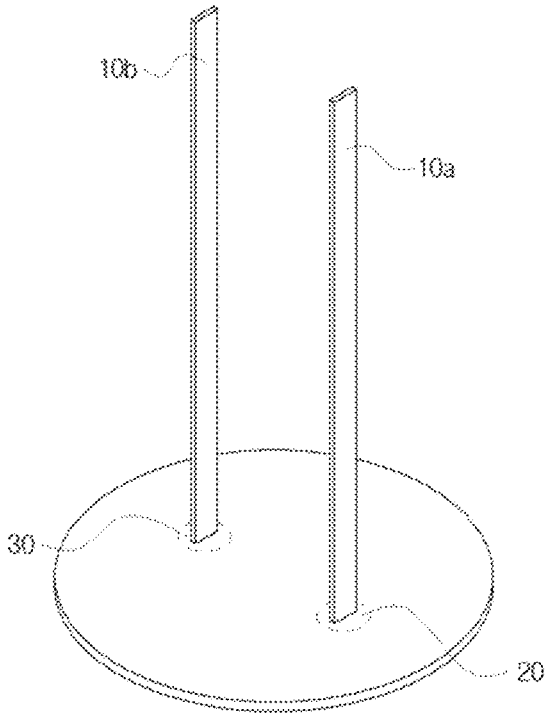
【FIG. 12】
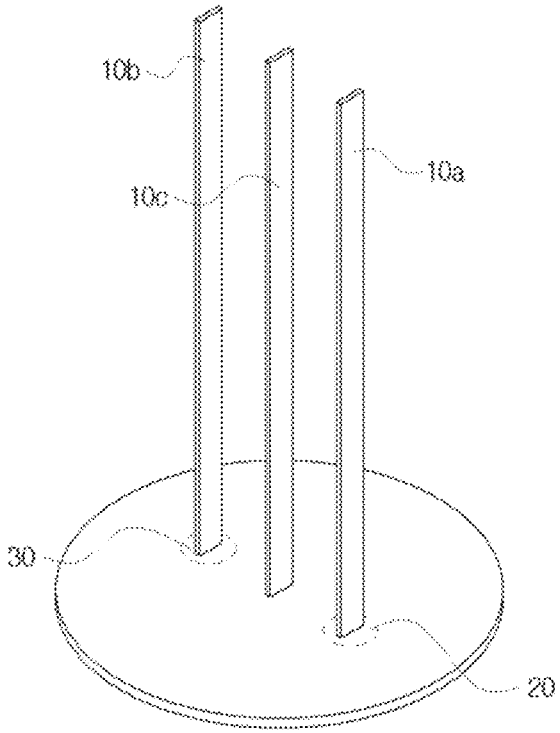

【FIG. 13】
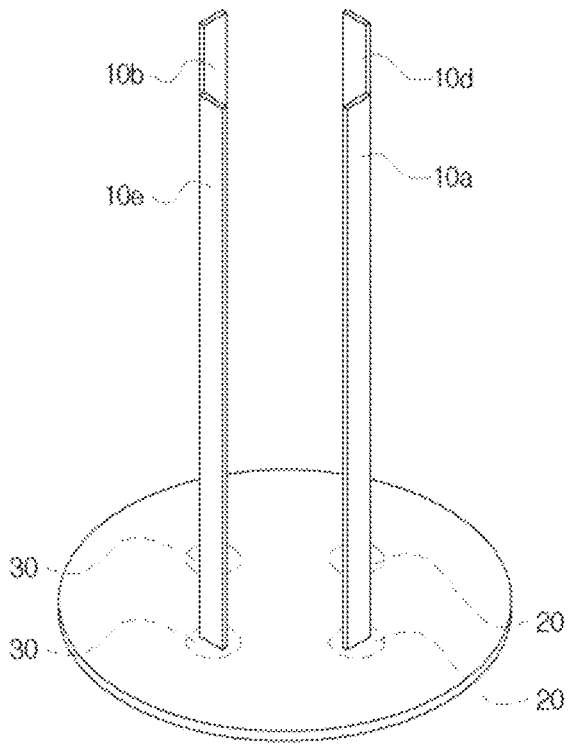
【FIG. 14】
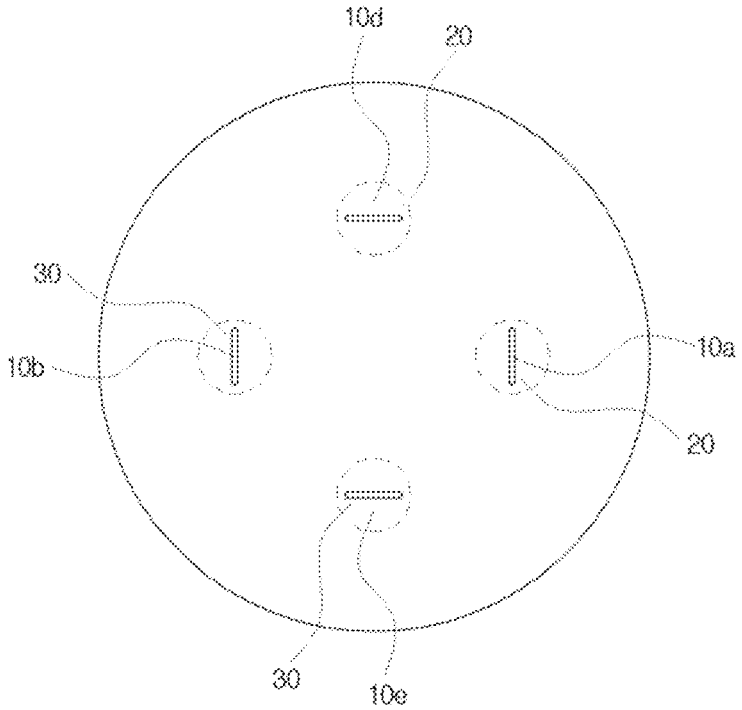

【FIG. 15】
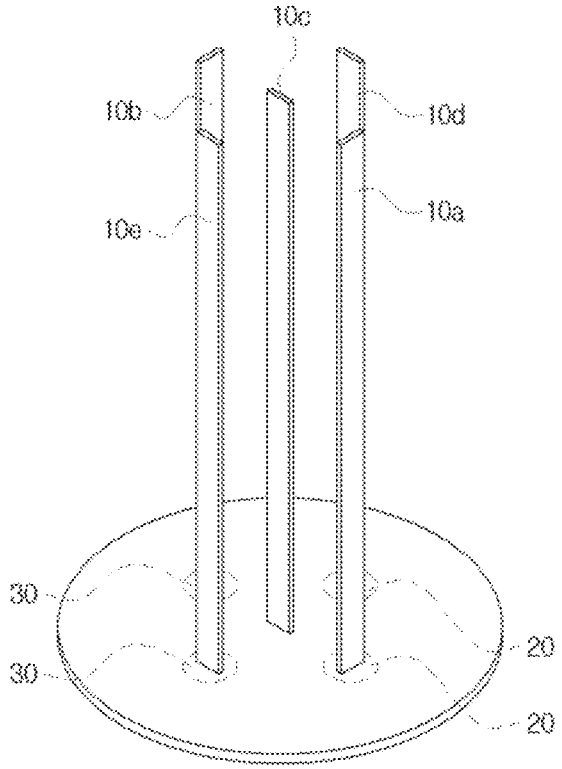
【FIG. 16】
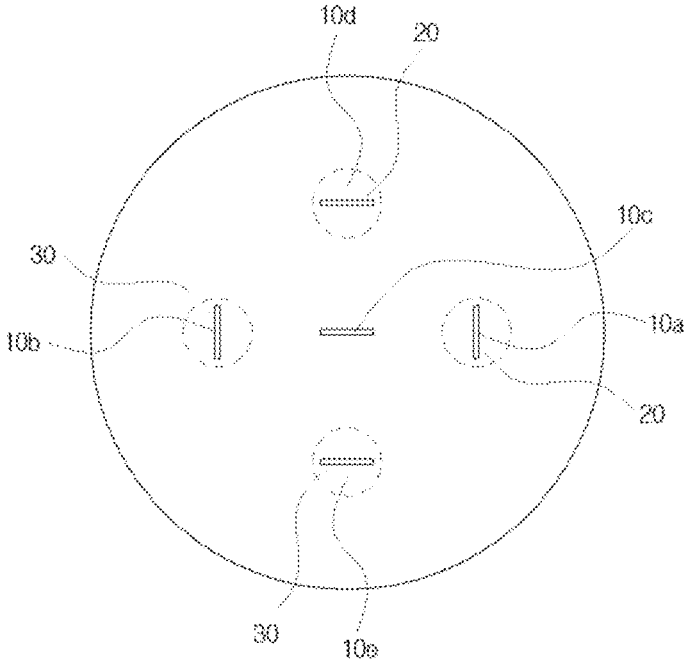

【FIG. 17】
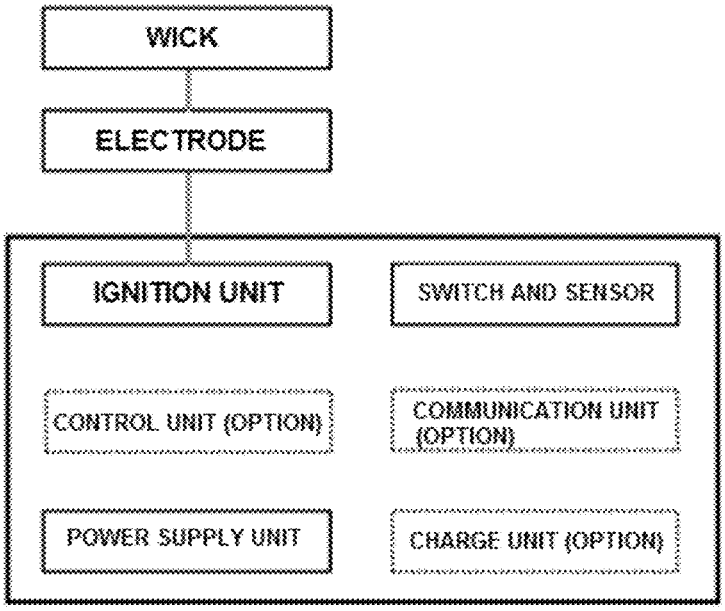
【FIG. 18】
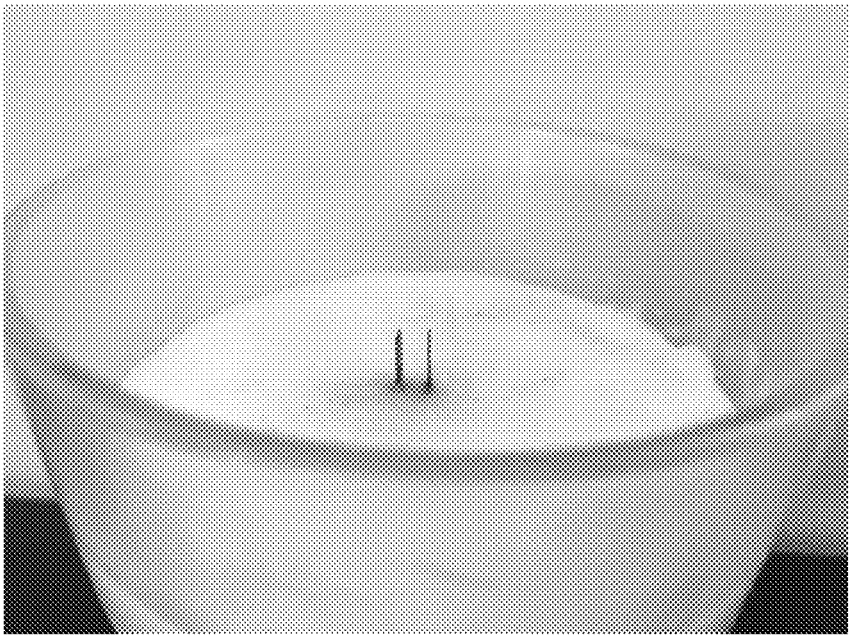

【FIG. 19】
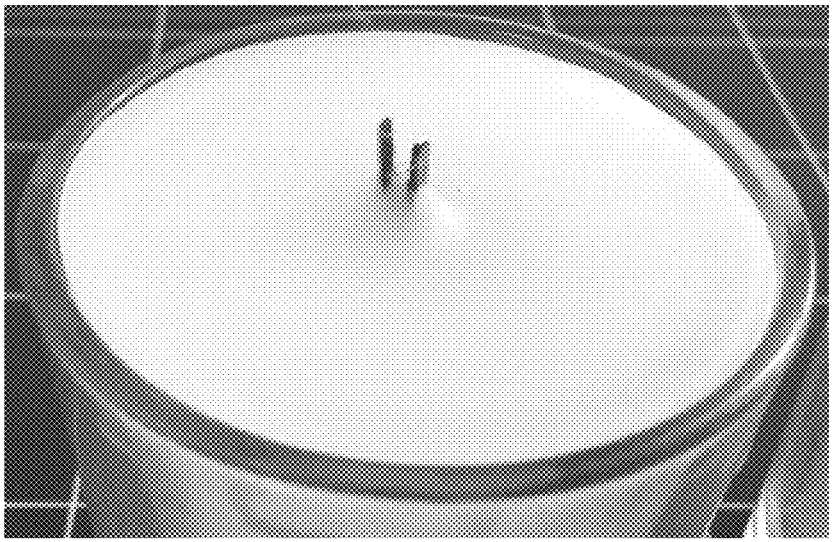

AUTO-IGNITION UNIT FOR CANDLES AND CANDLES CONTAINING THEREOF

CROSS-REFERENCE TO RELATED APPLICATIONS

This application claims priority under 35 U.S.C. § 119 to Korean Patent Application No. 10-2016-0099694, filed on Aug. 4, 2016, in the Korean Intellectual Property Office, the disclosure of which is incorporated herein by reference in its entirety.

Technical Field

The following disclosure relates to an auto-ignition unit for a candle and a candle including the same.

Background

A candle may provide a warm and special mood as a natural light source unlike an artificial light source such as electric lighting, and have additional advantages such as deodorization, fragrance, and the like, such that use of the candle has gradually increased. The candle is lighting fuel manufactured by molding paraffin, beeswax, or the like, and a combustible solid and inserting a wick into the center of the candle. In the case of lighting the wick, the candle is melted, and the melted candle rises upwardly along the wick by a capillary phenomenon to thereby be vaporized and combusted at a distal end portion of the wick, such that a flame burns. A combustion temperature of a surface flame of the candle is 1400° C. or more, a temperature of a lightest inner flame thereof is 1200° C. or more, and a temperature of a flame center thereof is 400 to 900° C.

In order to light the wick of the candle, a separate ignition device such as a match, a lighter, or the like, is required. This causes inconveniences at the time of using the candle, and in the case in which there is no ignition device, it is impossible to use the candle itself. In addition, at the time of lighting the candle using the ignition device, there is a risk of a burn, or the like.

A wick of a candle having a cross (+) shape in which the wick of a candle is perpendicularly oriented has been disclosed in U.S. Patent Application Publication No. 2012-0148966. In this case, the wick of a candle may be supported in an upright manner through the cross (+) shape, but similarly to the related art, the candle may be lighted only by an ignition device.

RELATED ART DOCUMENT

Patent Document

U.S. Patent Application Publication No. 2012-0148966

SUMMARY

An embodiment of the present invention is directed to providing an auto-ignition unit for a candle capable of performing auto-ignition, and a candle including the same.

In one general aspect, an auto-ignition unit for a candle includes a wick containing a conductive material, wherein the wick is ignited by a discharge.

The auto-ignition unit for a candle may include two or more wicks spaced apart from each other.

The conductive material may be one or two or more selected from a conductive carbon material, a conductive polymer, and a metal.

The conductive material may be one or two or more forms selected from a fiber, a particle, a tube, and a plate.

The wick may include a conductive member, wherein the conductive member includes a non-conductive matrix; and a conductive material dispersedly coupled to the non-conductive matrix.

The non-conductive matrix may be porous.

The non-conductive matrix may be one or two or more forms selected from a thread, woven fabric, and non-woven fabric of non-conductive fiber.

The wick may include a conductive member, wherein the conductive member may be foam, a film, a mesh, felt, a wire, or a perforated film of the conductive material.

The wick may further include a non-conductive member coupled to the conductive member.

The non-conductive member may be porous.

The wick may include two or more conductive members spaced apart from each other, and the non-conductive member may be interposed between the conductive members.

In the wick, two or more conductive members may be inserted into the non-conductive member so as to be spaced apart from each other.

The non-conductive member may be a supporter of the conductive member.

In the wick, the non-conductive member and the conductive member may be alternately laminated, but the non-conductive member may be positioned at an outermost portion of a laminate.

The non-conductive member may include a through pore.

The wick may include a dipping region dipped in fuel of a candle which is fuel used at the time of combustion of the wick and a protrusion region protruding outside of the fuel of the candle, and the through pore of the non-conductive member positioned in the dipping region may be filled with combustible solid fuel.

The wick may include a laminate in which a first conductive member, the non-conductive member, and a second conductive member are sequentially laminated, and the non-conductive member may be positioned inward based on one end of the laminate.

The wick may include a laminate selected from the following i) to vi):

i) a laminate of the conductive member and a non-porous non-conductive member, ii) a laminate of the conductive member and a porous non-conductive member, iii) a laminate of a first conductive member, a porous non-conductive member, and a second conductive member iv) a laminate of a first conductive member, a non-porous non-conductive member, and a second conductive member, v) a laminate of a non-porous first non-conductive member, a first conductive member, a porous second non-conductive member, and a second conductive member, vi) a laminate of a non-porous first non-conductive member, a first conductive member, a porous second non-conductive member, a second conductive member, and a non-porous third non-conductive member.

The carbon material may be one or two or more selected from carbon fiber, activated carbon, carbon nanotube, graphite, carbon black, graphene, reduced graphene oxide, and a carbon composite material, the conductive polymer may be one or two or more selected from polyacetylene, polyaniline, polypyrrole, and polythiophene, and the metal may have a melting temperature (Tm) of 150 to 500° C.

The non-conductive member may be one or two or more selected from woods, fibers, and combustible solid fuel.

The auto-ignition unit for a candle may further include an electrode positioned at a lower end of the wick and electrically connected to the wick.

The auto-ignition unit for a candle may further include an ignition means applying a voltage to the electrode; and a power supply unit supplying power at least to the ignition means.

The ignition means may generate any one or more discharges selected from an arc discharge, a flame discharge, a corona discharge, and a glow discharge.

The power supply unit may be a wired or wireless power supply unit.

The auto-ignition unit for a candle may further include a sensor for sensing a temperature, gas, heat, or light.

The auto-ignition unit for a candle may further include a communication unit receiving or transmitting and receiving an electric signal; and a control unit controlling the ignition means by the electric signal received from the communication unit.

The auto-ignition unit for a candle may further include an upper case having a housing shape in which an upper portion thereof is opened, and accommodating liquid or solid fuel and the wick therein; and a lower case disposed below the upper case, accommodating the ignition means and the power supply unit, and coupled to the upper case, wherein a bottom surface of the upper case is provided with an electrode connected to the wick while penetrating through the bottom surface of the upper case.

In another general aspect, an auto-ignition candle includes the auto-ignition unit for a candle as described above.

The auto-ignition candle may further include one or two or more fuels selected from paraffin wax, paraffin oil, soy wax, bees wax, palm wax, and gel wax.

The fuel may further contain one or two or more additives selected from perfumes and dyes.

The auto-ignition candle may further include a fuel part including solid fuel, a wick penetrating through the solid fuel so as to protrude one end thereof, and an electrode connected to the other end of the wick; and a body accommodating an ignition means and a power supply unit therein, and having an upper surface on which the fuel part is seated, the ignition means applying a voltage to the wick through the electrode, and the power supply unit supplying power to the ignition means, wherein a connection terminal is formed at a position of the upper surface of the body corresponding to the electrode of the seated fuel part.

The body may further include a communication unit receiving or transmitting and receiving an electric signal and a control unit controlling the ignition means by the electric signal received from the communication unit.

The fuel part may be detached from and attached to the body by mechanical coupling or magnetic force.

In another general aspect, a candle includes: solid fuel; a wick penetrating through the solid fuel so as to protrude one end, and containing a conductive material; and an electrode connected to the other end of the wick.

BRIEF DESCRIPTION OF THE DRAWINGS

FIG. 1 is a diagram of a wick including a conductive member in which a conductive material 200*b* is dispersedly coupled to a non-porous non-conductive matrix 200*a* according to an exemplary embodiment of the present invention.

FIG. 2 is a diagram of a wick including a conductive member in which a conductive material 100*b* is dispersedly coupled to a porous non-conductive matrix 100*a* according to an exemplary embodiment of the present invention.

FIG. 3 is a diagram illustrating a case in which a conductive member of the wick according to an exemplary embodiment of the present invention is a mesh.

FIG. 4 is a diagram illustrating a case in which a conductive member of the wick according to an exemplary embodiment of the present invention is felt.

FIG. 5 is a diagram illustrating a case in which a conductive member of the wick according to an exemplary embodiment of the present invention is a perforated film.

FIG. 6 is a diagram of a wick including a non-conductive member 40*a* coupled to a conductive member 40*b* according to an exemplary embodiment of the present invention.

FIG. 7 is a diagram of a wick including a non-conductive member 50*a* interposed between conductive members 50*b* and 50*c* according to an exemplary embodiment of the present invention.

FIG. 8 is a diagram of a wick in which a non-conductive member and a conductive member according to an exemplary embodiment of the present invention are alternately laminated.

FIG. 9 is a diagram of a wick in which conductive members are inserted into a non-conductive member according to an exemplary embodiment of the present invention so as to be spaced apart from each other.

FIG. 10 is a diagram of a wick in which conductive members are inserted into a non-conductive member according to an exemplary embodiment of the present invention so as to be spaced apart from each other.

FIG. 11 is a perspective diagram of an auto-ignition unit for a candle including two wicks according to an exemplary embodiment of the present invention.

FIG. 12 is a perspective diagram of an auto-ignition unit for a candle including three wicks according to an exemplary embodiment of the present invention.

FIG. 13 is a perspective diagram of an auto-ignition unit for a candle including four wicks according to an exemplary embodiment of the present invention.

FIG. 14 is a cross-sectional diagram of the auto-ignition unit for a candle including four wicks according to an exemplary embodiment of the present invention.

FIG. 15 is a perspective diagram of an auto-ignition unit for a candle including five wicks according to an exemplary embodiment of the present invention.

FIG. 16 is a cross-sectional diagram of the auto-ignition unit for a candle including five wicks according to an exemplary embodiment of the present invention.

FIG. 17 is a block diagram of an auto-ignition unit according to an exemplary embodiment of the present invention.

FIG. 18 is an optical microscope photograph of a candle manufactured in Example 1.

FIG. 19 is an optical microscope photograph of a candle manufactured in Example 2.

DETAILED DESCRIPTION OF EMBODIMENTS

Hereinafter, an auto-ignition unit for a candle according to the present invention and a candle including the same will be described in detail. The following accompanying drawings are provided by way of example so that the idea of the present invention can be sufficiently transferred to those skilled in the art to which the present invention pertains. Therefore, the present invention is not limited to the drawings to be provided below, but may be modified in different forms. In addition, the drawings to be provided below may be exaggerated in order to clarify the scope of the present invention. Here, technical terms and scientific terms used in the present specification have the general meaning understood by those skilled in the art to which the present invention pertains unless otherwise defined, and a description for the known function and configuration unnecessarily obscuring the gist of the present invention will be omitted in the following description and the accompanying drawings. In addition, unless the context clearly indicates otherwise, it should be understood that a term in singular form used in the specification and the appended claims includes the term in plural form.

The auto-ignition unit for a candle according to the present invention includes a wick containing a conductive material, wherein the wick may be ignited by a discharge (electric discharge). That is, the auto-ignition unit for a candle according to the present invention includes the wick having conductivity by containing the conductive material. Here, when a direction in which the wick is combusted is a length direction of the wick, the wick may have conductivity at least in the length direction of the wick due to the conductive material. In detail, the wick may be a conductive wick containing the conductive material to thereby have a current path formed between both ends thereof at least in the length direction thereof.

Describing the present invention in detail, any conductive wick may be used as long as a voltage applied to the wick is transferred in the length direction of the wick and the conductive wick has electric conductivity enough to generate a discharge at one end of the wick in the length direction. Therefore, the wick having electric conductivity enough to generate the discharge as described above may be defined as the conductive wick. In detail, the conductive wick may be a wick having electric conductivity of $10^5$ or more based on electric conductivity of fuel for a candle used as fuel at the time of combustion of the wick, more substantially, the electric conductivity of wick may be $10^2$ to $10^8$ S/m, As described above, the auto-ignition unit for a candle according to the present invention may include the wick having conductivity by the conductive material, and be ignited by the discharge occurring at one end of the wick in the length direction by electric stimulation (voltage, or the like) applied to the wick. Therefore, there is no need for a separate ignition device, and there is no need for a user to directly ignite the wick, such that the auto-ignition unit for a candle is significantly safe, and the user may ignite a candle only by controlling whether to apply electric stimulation, such that use of the auto-ignition unit for a candle is significantly convenient.

In the auto-ignition unit for a candle according to an exemplary embodiment of the present invention, the conductive material may include one or two or more selected from a conductive carbon material, a conductive polymer, and a metal.

As a specific example, the conductive carbon material may be one or two or more selected from carbon fiber, activated carbon, carbon nanotube, graphite, carbon black, graphene, reduced graphene oxide, and a carbon composite material, but the conductive carbon material is not particularly limited as long as the object of the present invention may be achieved.

As a more specific example, the carbon fiber may be one or two or more selected from rayon based carbon fiber, polyacrylonitrile (PAN) based carbon fiber, pitch based carbon fiber, and the like, but is not limited thereto. The carbon composite material may be a material obtained by increasing mechanical strength of an existing carbon fiber. As an example, the carbon composite material may be a carbon (C)-carbon (C) composite material of which strength is increased by impregnating and carbonating carbon fiber in a phenolic resin to thereby be graphitized at a high temperature of 1000 to 2500° C., or the like.

According to the exemplary embodiment of the present invention, the conductive polymer may be a polymer in which an electron and/or a hole may move. As a specific example, the conductive polymer may be one or two or more selected from polyacetylene based polymers, polyaniline based polymers, polypyrrole based polymers, polythiophene based polymers, and the like, but is not limited thereto. As a more specific example, the conductive polymer may be one or two or more selected from polyacetylene (PA), polyaniline (PANI), polypyrrole (PPy), polythiophene (PT), poly(3,4-ethylenedioxythiophene) (PEDOT), polyisothianaphthene (PITN), polyphenylene vinylene(PPV), polyphenylene(PPE), polyphenylene sulfide (PPS), polysulfur nitride (PSN), and the like.

According to the exemplary embodiment of the present invention, since the metal itself is a good conductor, any metal may be used without particular limitation, but it is preferable that the metal is a metal having a melting temperature (Tm) of 150 to 500° C. It is preferable that the metal is a metal of which a vapor is harmless to a human body at the time of combustion. In this regard, the metal may be preferably zinc or tin which may be vaporized at a flame temperature and be safe at the time of combustion, but is not limited thereto.

As described above, the conductive material may be the conductive carbon material, the conductive polymer, the metal, or a mixture thereof, or a composite composed of conductive materials different from each other. The composite as described above may have a structure in which first and second conductive materials are simply mixed with each other, a structure in which a shell made of a second conductive material encloses a core made of a first conductive material, a structure in which a second conductive material is loaded or embedded in a matrix made of a first conductive material, a structure in which a second conductive material is coated or loaded in a first conductive material having a zero-dimensional structure (particles, or the like), a one-dimensional structure (wires, or the like), or a two-dimensional structure (films, or the like), or a stacking structure (including a laminate of particles) in which first and second conductive materials are laminated while forming layers, respectively, but is not limited thereto.

It is advantageous that the conductive material includes the carbon material and/or the metal. Since the carbon material and the metal are excellent conductors and are vaporized without ash at the time of combustion, such that the carbon material and the metal are preferable. Further, in the case in which the conductive material is the conductive carbon material, at the time of combustion of the wick, the carbon material is entirely directly vaporized into carbon dioxide, thereby making it possible to significantly prevent soot or ash from being generated. Therefore, it is more advantageous that the conductive material is the conductive carbon material.

According to the exemplary embodiment of the present invention, the conductive material may have one or two or more forms selected from a fiber, a particle, a tube, and a plate. Hereinafter, the conductive material having one or two or more forms selected from the fiber, the particle, the tube, and the plate will be referred to as a conductive unit.

The wick may include a conductive network in which the conductive units are physically entangled with each other, physically contact each other, or are physically bound to each other. That is, the conductive network may be a structure body in which a continuous current path is formed by physically contacting the conductive units or physically binding (including fusing) the conductive units to each other. In the case in which the wick includes the conductive network, the conductive unit may include a one-dimensional structure having a large aspect ratio such as the fiber form and/or the tube form. The one-dimensional structure as described above is advantageous in that a network may be stably formed with only of a small amount of conductive unit. In the case in which the wick includes the conductive network, the conductive unit may further include the two-dimensional structure such as the plate form and/or the zero-dimensional structure such as the particle form together with the one-dimensional structure having a large aspect ratio such as the fiber form and/or the tube form. The two-dimensional structure and/or the zero-dimensional structure as described above may further increase contact points between the conductive units.

A fiber-type conductive unit is not particularly limited, but may include one or two or more selected from a conductive carbon material fiber (hereinafter conductive carbon fiber), a conductive polymer fiber, a metal fiber, and the like. The fiber-type conductive unit may have an average diameter of several ten nanometer orders to several hundred micrometer orders and an average length of several ten micrometer orders to several meter orders. In detail, the fiber-type conductive unit may have an average diameter of 10 nm to 50 μm, specifically, 1 μm to 30 μm and an average long axis length of 10 μm to 10 m. In the case in which the conductive network is substantially formed by irregular contacts between the fiber-type conductive units, the conductive unit may be a short fiber which is advantageous for dispersion, and in the case in which the conductive network is formed by artificial arrangement such as weaving, or the like, of the conductive units, the conductive unit may be a long fiber which is advantageous for artificial arrangement. As an example, the short fiber may be a fiber having an average long axis length of 10 μm to 500 μm, and the long fiber may be a fiber having an average long axis length longer than 500 μm, substantially 0.5 mm to 10 m, and more substantially, 1 mm to 10 cm, but the short fiber and the long fiber are not limited thereto.

A tube-type conductive unit is not particularly limited, but may be a conductive carbon nanotube, which is a conductive carbon material. Here, the conductive carbon nanotube may be a single walled nanotube, a double walled nanotube, or a multi-walled nanotube, and may be a rope nanotube in which several single walled nanotubes are lumped. As a specific example, the carbon nanotube may have an average diameter of 300 nm or less, specifically 0.1 to 200 nm, and more specifically, 1 to 100 nm, and an average length of 1 to 1000 μm, specifically 100 to 500 μm, but is not limited thereto.

A particle-type conductive unit is not particularly limited, but as a specific example, the particle-type conductive unit may be a conductive carbon particle such as activated carbon, graphene, carbon black, a crumpled graphene particle, crumpled reduced graphene oxide (RGO) particle, a metal particle, or a mixture of the conductive carbon particle and the metal particle. The particle may have an average particle size of 10 to 5000 nm, more specifically 100 to 3000 nm, but is not limited thereto. As an example, the plate-type conductive unit may be a plate made of one or two or more selected from graphene and reduced graphene oxide (RGO), which are conductive carbon materials, a metal plate, or the like, but is not limited thereto.

According to the exemplary embodiment of the present invention, the wick may include the conductive member. In detail, the wick may include the conductive member containing the conductive material. Here, the wick may have conductivity in the length direction of the wick due to the conductive member.

A physical size and shape of the conductive member may be suitably adjusted in consideration of a shape or size of a designed candle so as to form a flame having an aesthetically excellent shape and be advantageous for discharge. From a macroscopic point of view, the conductive member may have a plate shape, a strip shape, a flat plate strip shape, a wire shape, a bar shape, a hollow pillar shape, or the like. In this case, a cross-section (a cross-section perpendicular to the length direction) of a bar-shaped conductive member may have a circular shape, an oval shape, or a polygonal shape ranging from triangular to octagonal shapes, and a cross-section of a hollow pillar-shaped conductive member may have a circular loop shape, an oval loop shape, or a polygonal loop shape ranging from triangular to octagonal loop shapes, but the present invention is not limited thereto. However, the conductive member has a flat one surface such as in the flat plate strip shape, which is advantageous in that an opposing area in which a discharge may occur is wide. As a specific and non-restrictive example, the conductive member may have a length of 1 to 50 cm, specifically 3 to 30 cm, and more specifically, 5 to 15 cm, but is not limited thereto. In addition, an average diameter or width (or thickness) of the conductive member may be 0.01 to 100 mm, specifically, 0.1 to 50 mm, and more specifically 0.5 to 20 mm, but is not limited thereto.

The conductive member may be the above-mentioned conductive network itself. Alternatively, the conductive member may include a non-conductive matrix and a conductive unit dispersed in the non-conductive matrix. Here, the conductive unit dispersed in the non-conductive matrix may form a conductive network by contacts (including entanglement, binding, or the like) between the conductive units. The conductive unit may be in a state in which the conductive unit is dispersed and impregnated in the non-conductive matrix, but is not limited thereto. That is, the conductive unit may be in a state in which it is coated on a surface of the non-conductive matrix.

The conductive member includes a non-conductive matrix, (a combustible non-conductive matrix); and a conductive unit dispersedly impregnated in the non-conductive matrix to form a conductive network, which is advantageous in that it is possible to secure mechanical properties (as an example, physical strength, or the like) required in the wick due to the non-conductive matrix, and it is possible to decrease high thermal conductivity caused by the conductive material while securing conductivity. In detail, thermal conductivity of the conductive member may be decreased by the non-conductive matrix, thereby making it possible to prevent a tunnel phenomenon from occurring due to melting of the fuel of the candle around the wick.

As described above, in the case in which the conductive member includes the non-conductive matrix in addition to the conductive material, it is advantageous that the non-conductive matrix is a material having low thermal conductivity while having electrical properties of a insulator or a semi-conductor. As an example, the non-conductive matrix may be a insulator having thermal conductivity lower than 1 W/m·K, specifically, lower than 0.4 W/m·K, and more specifically, in a range of 0.01 to 0.2 W/m·K.

Describing a shape of the non-conductive matrix, the non-conductive matrix may be a porous matrix or a non-porous (dense) matrix. The non-porous (dense) matrix may mean a matrix in which intentional (or artificial) pores are not formed, and the porous matrix may mean a matrix having an open pore structure.

In the case in which the non-conductive matrix is the dense matrix, the conductive member may have a structure in which the conductive units are randomly arranged on or dispersedly coupled to a surface of the non-conductive matrix to form a conductive network. That is, the conductive member may include the dense non-conductive matrix and the conductive network (a network of the conductive units) coupled to one surface of the non-conductive matrix.

In the case in which the non-conductive matrix is the dense matrix, the conductive member may have a structure in which the conductive unit is impregnated and dispersed in the non-conductive matrix to form a conductive network.

However, the conductive member should not be interpreted as being limited to securing conductivity in the length direction by the network based on the conductive unit. As an example, the conductive member may have conductivity in the length direction by arranging and positioning conductive long fibers (thread) or conductive strips to be spaced apart from each other on the surface or the inside of the non-conductive matrix so as to cross the non-conductive matrix in the length direction.

In the case in which the non-conductive matrix is the dense matrix, the non-conductive matrix may be made of a semiconductor or insulator and a combustible organic material. Preferably, the non-conductive matrix may be made of an organic material satisfying the above-mentioned thermal conductivity. As a specific and non-restrictive example, non-conductive matrix may be made of a resin such as low-density polyethylene (LDPE), linear low-density polyethylene (LLDPE), a polyethylene resin, a polyisoprene resin, a ethylenevinylacetate (EVA) resin, polyethylene carbonate, polypropylene polycarbonate, a phenol-formaldehyde resin, or the like; a lumber (compressed lumber) similar to a medium density fiberboard (MDF), a particle board (PB), plywood; combustible solid fuel including soy wax, bees wax, gel wax, paraffin wax, or mixed wax thereof, or the like, but is not limited thereto.

In the case in which the conductive member includes the non-conductive matrix, a macroscopic shape of the conductive member may be defined by the non-conductive matrix. The non-conductive matrix may have a plate shape, a strip shape, a flat plate strip shape, a wire shape, a bar shape, a hollow pillar shape, or the like. In this case, a cross-section (a cross-section perpendicular to the length direction) of a bar-shaped non-conductive matrix may have a circular shape, an oval shape, or a polygonal shape ranging from triangular to octagonal shapes, and a cross-section of a hollow pillar-shaped non-conductive matrix may have a circular loop shape, an oval loop shape, or a polygonal loop shape ranging from triangular to octagonal loop shapes, but the present invention is not limited thereto.

FIG. 1, which is a diagram illustrating a conductive member of a wick according to an exemplary embodiment of the present invention, is a diagram illustrating a conductive member in which a conductive unit 200*b* is dispersedly coupled to a non-porous non-conductive matrix 200*a*. In detail, FIG. 1 is a diagram illustrating a case in which a fiber-type conductive unit 200*b* is randomly dispersedly coupled to a surface of the non-porous non-conductive matrix 200*a* to form a conductive network, as the conductive member, but the present invention is not limited thereto.

As described above, the conductive member may include the non-conductive matrix and the conductive unit, wherein the non-conductive matrix may be the porous matrix. The porous matrix is advantageous in that even though an insulating material forming the matrix does not satisfy the above-mentioned thermal conductivity, thermal conductivity of the non-conductive matrix may be decreased by pores, and fuel of the candle may be moved to an upper end portion of the wick by a capillary phenomenon.

The porous non-conductive matrix may be a porous insulating matrix, and may have a porous web form based on fiber, and the porous web form based on the fiber may include any one or more selected from a thread form, a woven fabric form, and a non-woven fabric form of the fiber, or a laminate thereof.

As a specific example, the porous web form may has one or two or more selected from the thread form, the woven fabric form, and the non-woven fabric form of the fiber. As used herein, the term "thread form" means a thin and long thread form. The thread form is not particularly limited, but may be a short fiber, a long fiber, a twisted thread, or the like. The thread may have an average diameter of 0.1 to 500 μm, and an average length of 1 μm to 30 cm. In the case in which the average diameter and the average length of the thread are within the above-mentioned ranges, respectively, strength of the non-conductive matrix may be physically constantly maintained, and it may be easy to deform the non-conductive matrix in various forms. The non-conductive matrix may also include woven fabric or non-woven fabric of the thread in addition to the woven fabric or non-woven fabric of the fiber. That is, the non-conductive matrix may include the woven fabric such as plain woven fabric, satin woven fabric, twilled woven fabric, or the like, or non-woven fabric using the thread. Further, the woven fabric may include fabric woven through a braiding process, a 3-dimensional weaving process, a contour warp knitting or net-type weft knitting process, or the like.

When the non-conductive matrix is porous, in view of low thermal conductivity and ease of movement of a material (fuel) by the capillary phenomenon, the non-conductive matrix may have an apparent porosity of 20 to 80%, and specifically, 30 to 70%, and the conductive member may also have an apparent porosity of 20 to 80%, and specifically, 30 to 70%. Here, an average pore size of the non-conductive matrix and the conductive member may be 100 to 2000 nm, specifically, 200 to 1000 nm, but is not limited thereto.

The conductive member may include the porous non-conductive matrix; and the conductive unit dispersedly coupled to the surface and/or the inside of the porous non-conductive matrix. As a specific example, the conductive member of the wick may have a structure in which the conductive unit is dispersedly coupled together with the non-conductive fiber forming the porous non-conductive matrix, but the conductive unit forms a conductive network. Here, the conductive unit is the fiber form or the tube form, which is advantageous in view of forming the conductive network and maintaining a high porosity of the conductive member.

That is, the conductive member may be a thread form, a woven fabric form, and/or non-woven fabric containing the non-conductive fiber and a fiber-type or tube-type conductive unit.

However, the present invention is not limited thereto, but the conductive member may also have a structure in which a conductive network of the conductive unit is coupled to a surface of the woven or non-woven fabric of the non-conductive matrix.

FIG. 2 illustrates the conductive member of the wick according to the exemplary embodiment of the present invention having a shape in which a conductive unit is dispersedly coupled to a porous non-conductive matrix. FIG. 2 illustrates an example of a structure of the conductive member of the wick in which a fiber-type non-conductive matrix 100*a* and a fiber-type conductive unit 100*b* are dispersedly coupled to each other by physical contacts therebetween to form a non-woven fabric, but the conductive unit 100*b* forms a conductive network.

A fiber (non-conductive fiber) of the fiber-type non-conductive matrix may be one or two or more selected from natural fiber and synthetic fiber. The natural fiber is more advantageous in that gas generated at the time of combustion is harmless to a human body.

The natural fiber may be one or two or more selected from pulp, which is a cellulose based fiber, cotton, flax, hemp, jute, kenaf, bamboo, ramie, sisal, silk fabric, and the like, but is not limited thereto.

Here, the pulp is a cellulose based fiber fibrillated so as to include a number of twigs through mechanical or chemical treatment, and a stem of the fiber has a diameter of several ten μm, but the twigs connected to the stem has a diameter of several μm and are complicatedly connected to each other, such that the pulp may have a 3-dimensional mesh structure. The pulp and the conductive unit may be easily physically coupled or entangled with each other due to the 3-dimensional mesh structure, and the conductive unit may be dispersed in a stable shape in the mesh structure of the pulp without special treatment, thereby forming a non-conductive matrix having a high porosity. As a specific example, the pulp may be a wood pulp made of a broad-leaf tree such as white birch, eucalyptus, oak, or the like, and a needle-leaf tree such as pine, fir, or the like, or a non-wood pulp made of plant fiber such as straw, cotton, cortex of paper mulberry, or the like.

As a specific example, the synthetic fiber may be any one or a mixed fiber of two or more selected from a polyamide based fiber, a polyolefin based fiber, a polyester based fiber, a polyvinyl alcohol based fiber, a polyacrylate based fiber, a polyurethane based fiber, and the like, and may be a copolymer fiber manufactured by copolymerization with a comonomer. More specifically, the synthetic fiber may be one or two or more selected from nylon 6, nylon 66, a polyethylene fiber, a polypropylene fiber, a polyethylene terephthalate fiber, a polybutylene terephthalate fiber, a polyvinyl alcohol fiber, a polyacrylonitrile fiber, a poly (vinylchloride-co-acrylonitrile) fiber, a polyurethane fiber derived from butanediol, and the like.

In the case in which the conductive member is porous (that is, the conductive member includes the porous non-conductive matrix and the conductive unit), the conductive unit may be coupled to the non-conductive matrix by physical entanglement or coupling between the conductive unit and the non-conductive fiber forming the non-conductive matrix. However, unlike this, the conductive member may be in a state in which the conductive unit is physically bound to the non-conductive fiber itself or is bound to the non-conductive matrix by a binder.

In detail, the conductive unit is not separated from the fiber of the non-conductive matrix but may be integrated therewith while having strong binding strength by dispersing the conductive unit in the non-conductive matrix made of the non-conductive fiber using a blowing method or a spray method and then performing annealing at a temperature equal to or higher than a glass transition temperature of a polymer configuring the fiber of the non-conductive matrix to physically bind the conductive unit to the non-conductive fiber in a manufacturing process. An annealing time may be changed depending on the kind and diameter of the fiber. In detail, the annealing time may be 2 minutes or more, and more specifically, 5 to 60 minutes.

Unlike this, in the case in which the conductive member is in a state in which the conductive unit is bound to the non-conductive matrix by the binder, the conductive member may further contain a binder binding the non-conductive fibers to each other, binding the conductive units to each other, and/or binding the non-conductive fiber and the conductive unit to each other. The binder may improve a binding property between the non-conductive matrix and the conductive unit. The conductive member further contains the binder, such that stiffness of the conductive member may be further improved, thereby making it possible to more stably maintain a shape of the conductive member. In addition, the conductive material physically fixed to the non-conductive matrix is more strongly bound thereto by a binder, such that the conductive member may simultaneously have a high porosity by the non-conductive matrix and strong binding strength by the binder.

As a specific example, the binder may be a resin or combustible solid fuel. The binder resin may include any one or a mixture of two or more selected from a polyamide based resin, a polyvinyl based resin, a polyolefin based resin, a polyester based resin, an acrylate based resin, a cellulose based resin, an epoxy resin, a phenolic resin, and the like, but is not limited thereto. As a more specific example, the binder may be any one or a mixture of two or more selected from polyvinyl alcohol, polyvinylpyrrolidone, polyvinylbutyral, polyvinyl acetate, low-density polyethylene, linear low-density polyethylene, medium-density polyethylene, high-density polyethylene, polypropylene, an ethylene vinyl acetate resin, polyisoprene, nylon 6, nylon 66, polyethylene carbonate, polypropylene polycarbonate, bisphenol A-polycarbonate, polyethylene terephthalate, polybutylene terephthalate, polymethylmethacylate, methyl cellulose, carboxymethyl cellulose, an epoxy resin, a phenol-formaldehyde resin, paraffin, and the like. In detail, polyvinyl alcohol (PVA) is used as the binder resin, which is preferable in that toxic gas is not generated at the time of combustion and adhesion strength is excellent.

Unlike this, the binder may be the combustible solid fuel which is different from the fuel (a liquid or solid) of the candle and has a relatively higher melting temperature than that of the fuel of the candle. In detail, the melting temperature of the fuel used in the candle may be 40 to 70° C., and the binder may be solid fuel having a relatively higher melting temperature than that of the fuel used in the candle. As a more specific example, in the case in which the fuel of the candle is one or two or more selected from soy wax, bees wax, and gel wax, the binder may contain paraffin wax. As an example, the binder may be paraffin wax or mixed fuel in which paraffin wax is mixed with another combustible solid fuel (soy wax, beeswax, gel wax, or the like). In the case of the mixed fuel, the mixed fuel may contain the paraffin wax in a content of 10 wt % or more, specifically, 30 wt % or more, but is not limited thereto.

The binder may be contained in a content of 1 to 30 wt %, specifically, 5 to 20 wt %, based on a total weight of the conductive member. In the case in which the content of the binder satisfies the above-mentioned range, the binder may improve binding strength between the non-conductive matrix and the conductive material while maintaining the porosity of the non-conductive matrix.

The conductive member including the (porous or non-porous) non-conductive matrix as described above may include the conductive unit in a content enough to form a stable conductive network. As a specific example, in the conductive member, the non-conductive matrix and the conductive unit may have a weight ratio of 90:10 to 5:95 (non-conductive matrix:conductive unit), more specifically, 30:70 to 15:85, but is not limited thereto.

However, in the present invention, the conductive member is not limited to the structure in which the conductive member includes the non-conductive matrix and the conductive unit dispersedly coupled to the non-conductive matrix. As described above, the conductive member may be made of the conductive material. As an example, the conductive member may be foam, a film, a mesh, felt, a wire, or a perforated film of one or two or more conductive materials selected from a conductive carbon material, a conductive polymer, and a metal, or a laminate thereof. Further, the conductive member may be the conductive network itself of the conductive unit. In the case in which the conductive member is made of the conductive material, the conductive member has a porous structure such as the foam, the mesh, the felt, or the perforated film of the conductive material, which is advantageous in view of low thermal conductivity. Here, the conductive member of the wick may have a porosity (apparent porosity) of 40 to 90%, specifically, 50 to 80%, but is not limited thereto.

FIGS. 3 to 5 are diagrams illustrating examples of the conductive member of the wick according to the exemplary embodiment of the present invention. Referring to FIGS. 3 to 5, the conductive member of the wick may have a porous shape as illustrated in FIGS. 3 to 5. In detail, FIG. 3 illustrates a case in which the conductive member of the wick is a mesh, FIG. 4 illustrates a case in which the conductive member of the wick is felt, and FIG. 5 illustrates a case in which the conductive member of the wick is a perforated film.

According to the exemplary embodiment of the present invention, the wick may further include a non-conductive member (insulating member) coupled to the conductive member.

The non-conductive member may be a combustible non-conductive member, and be coupled to the conductive member, such that the non-conductive member may also serve as a heat transfer barrier preventing heat from being transferred from the conductive member to the fuel while serving as a supporter physically supporting the conductive member.

The non-conductive member may have a shape corresponding to the conductive member, but is not limited thereto. The non-conductive member has a plate shape, a strip shape, a flat plate strip shape, a wire shape, a bar shape, a hollow pillar shape, or the like, independently of the conductive member. In this case, a cross-section (cross-section perpendicular to a length direction) of a bar-shaped non-conductive member may have a circular shape, an oval shape, or a polygonal shape ranging from triangular to octagonal shapes, and a cross-section of a hollow pillar-shaped non-conductive member may have a circular loop shape, an oval loop shape, or a polygonal loop shape ranging from triangular to octagonal loop shapes, but the present invention is not limited thereto. However, it is preferable that the non-conductive member has a length corresponding to a length of the conductive member coupled thereto, or a relatively shorter length than that of the conductive member. In detail, independently of the length of the conductive member, the non-conductive member may have a length of 1 to 50 cm, specifically 3 to 30 cm, and more specifically, 5 to 15 cm, but is not limited thereto. Independently of the conductive member, an average diameter or width of the non-conductive member may be 0.01 to 100 mm, specifically, 0.1 to 50 mm, and more specifically 0.5 to 20 mm, but is not limited thereto. However, when the conductive member has the above-mentioned size, even though the conductive member and the non-conductive member are coupled to each other, a flame of the wick may be formed to have a suitable size and excellent aesthetics.

The non-conductive member may also be porous or non-porous, independently of the conductive member. The non-porous (dense) non-conductive member may mean that intentional (or artificial) pores are not formed therein, and the porous non-conductive member may mean that the non-conductive member has an open pore structure.

In view of a role of the supporter, the non-porous non-conductive member is more advantageous in that even though the non-conductive member has significantly thin membrane (plate) shape, the wick may stand while enduring its own weight. Further, the conductive member and non-conductive member included in the wick may be a porous conductive member and a non-porous non-conductive member; a porous conductive member and a porous non-conductive member; a non-porous conductive member and a non-porous non-conductive member; or a non-porous conductive member and a porous non-conductive member. Here, at least one of the conductive member and the non-conductive member is porous, which is advantageous in view of movement (supply) of the fuel to an upper end of the wick by the capillary phenomenon and a decrease in thermal conductivity of the wick itself.

As the non-conductive member, any material may be used as long as it is combustible and does not generate a toxic material to the human body at the time of combustion. As a specific and substantial example, the non-conductive member may be one or two or more selected from wood, fiber, and combustible solid fuel. However, the present invention is not limited by the material of the non-conductive member, and any material may be used as long as it is an insulating material, does not generate a toxic material at the time of combustion, similarly to the wood and the combustible solid fuel, is easily processed to have a desired shape, and may satisfy mechanical properties required in the wick.

The wood of the non-conductive member is not particularly limited, but as a specific example, the wood may be a broad-leaf tree and a needle-leaf tree such as pine, oak, maple, cherry tree, cypress, paper mulberry, and the like.

In the case in which the non-conductive member is the combustible solid fuel, the non-conductive member may be solid fuel which is different from the fuel of the candle and has a relatively higher melting temperature than that of the fuel of the candle. In detail, the melting temperature of the fuel used in the candle may be 40 to 70° C., and the non-conductive member may be solid fuel having a relatively higher melting temperature than that of the fuel used in the candle. As a more specific example, in the case in which the fuel of the candle is one or two or more selected from soy wax, bees wax, and gel wax, the non-conductive member, which is the combustible solid fuel, may contain paraffin wax. As an example, the non-conductive member may be the paraffin wax or a mixture in which paraffin wax is mixed with another combustible solid fuel (soy wax, beeswax, gel wax, or the like). In the case of the mixture, the mixture may contain the paraffin wax in a content of 10 wt % or more, specifically, 30 wt % or more, but is not limited thereto.

In the case in which the non-conductive member is non-porous, the non-conductive member may have a shape of a plate, a strip, a flat plate strip, a wire, a bar, a hollow pillar, or the like, of a wood or combustible solid fuel.

In the case in which the non-conductive member is porous, the non-conductive member may have a shape of a plate, a strip, a flat plate strip, a wire, or a bar of a wood in which a through pore is formed, or the combustible solid fuel. As a specific example, the through pore may be a pore penetrating through the non-conductive member in parallel with a lamination direction of the conductive member and the non-conductive member. Here, the lamination direction of the conductive member and the non-conductive member may be a direction perpendicular to the length direction of the wick. In the non-conductive member, a plurality of through pores may be regularly or irregularly arranged to be spaced apart from each other. A cross section of the through pore may have a circular shape, an oval shape, a polygonal shape ranging from triangular to octagonal shapes, or a band shape, but the present invention is not limited by the shape of the through pore. Further, in consideration of ease of physical processing, ease of discharge to be described below, maintenance of mechanical properties of the non-conductive member, and the like, an area of a single pore (a cross-sectional area of a single through pore), and pore density (the number of through pores per unit area of the non-conductive member) may be suitably adjusted. As a substantial example, a diameter of a single pore (a conversion diameter converted into a circle having the same cross-sectional area) may be 100 μm to 5 mm, and the pore density may be 0.1 ea/cm$^2$ to 1 ea/cm$^2$, but the present invention is not limited thereto.

Further, in the case in which the non-conductive member is porous, specifically, in the case in which the non-conductive member has the shape of the plate, the strip, the flat plate strip, the wire, the bar, or the hollow pillar of the wood in which the through pore is formed, the non-conductive member may further contain the fuel of the candle, filled in open pores (as an example, the through pore). In detail, the non-conductive member includes the through pore and may be in a state in which the through pore itself is filled with the combustible solid fuel including the wax such as the paraffin wax, the bees wax, and the like, capable of being used as fuel at the time of combustion of the candle. When the wick is combusted, in the case of a through pore positioned in the vicinity of one end of the combusted wick, fuel filled in the pore may be melted. Therefore, as the melted fuel may run out from the through pore, an empty space of the pore may be secured again. A configuration in which as the non-conductive member having the through pore and the fuel filled in the through pore are melted in a region adjacent to one end of the wick, the empty space of the pore is secured again is advantageous for a structure of a wick in which the non-conductive member is interposed between two conductive members described below. Here, it is preferable that through pores positioned adjacently to one end portion of the non-conductive member are not filled with the fuel but maintained in an empty state as it is so that a discharge may selectively and easily occur at one end of the wick at the time of igniting the candle.

Hereinabove, based on a case in which the non-conductive member has porosity by the through pore, an example of the pore filled with the fuel is described, but is not limited only to the through pore. That is, in the case in which the non-conductive member is porous, open pores of the non-conductive member may be in a state in which they are filled with the fuel. Further, in the case of a porous non-conductive member interposed between two conductive members, open pores positioned in a region of one end portion in which a discharge occurs may be in a state in which they are not filled with the fuel. In detail, as described below, the wick may be positioned to protrude from the fuel of the candle by a predetermined length, and open pores of the non-conductive member existing in a protrusion region may be in a state in which they are not filled with the fuel, and open pores of the non-conductive member existing in a region of the non-conductive member dipped in the fuel of the candle may be in a state in which they are filled with the fuel.

Fibers of the non-conductive member may be natural fiber and/or synthetic fiber, similarly to the fiber of the non-conductive matrix described above. The natural fiber may be one or two or more selected from pulp, which is a cellulose based fiber, cotton, flax, hemp, jute, kenaf, bamboo, ramie, sisal, silk fabric, and the like, but is not limited thereto. The synthetic fiber may be any one or a mixed fiber of two or more selected from a polyamide based fiber, a polyolefin based fiber, a polyester based fiber, a polyvinylalcohol based fiber, a polyacrylate based fiber, a polystyrene based fiber, a polyurethane fiber, and the like, and may be a copolymer fiber manufactured by copolymerization with a comonomer. More specifically, the synthetic fiber may be one or two or more selected from nylon 6, nylon 66, a polyethylene fiber, a polypropylene fiber, a polyethylene terephthalate fiber, a polybutylene terephthalate fiber, a polyvinylalcohol fiber, polyacrylonitrile fiber, a poly(vinylchloride-co-acrylonitrile) fiber, a polyurethane fiber derived from butanediol, and the like. Here, as the synthetic fiber, a fiber that is not toxic at the time of combustion may be preferable.

In the case in which the non-conductive member is porous, the non-conductive member may have a porous web structure based on the above-mentioned fibers (natural fiber and/or synthetic fiber). As an example, the non-conductive member may have one or two or more forms of a thread, woven fabric, and/or non-woven fabric of the fibers (natural fiber and/or synthetic fiber). Here, the thread is advantageous in that in the case of a plurality of fiber bundles, strength required for the non-conductive member to be upright may be maintained. Further, the woven fabric may include woven fabric such as plain woven fabric, satin woven fabric, twilled woven fabric, or the like, using the thread in addition to the woven fabric of the fiber, and the non-woven fabric may also include non-woven fabric using the thread in addition to the non-woven fabric of the fiber. Further, the woven fabric may include fabric woven through a braiding process, a 3-dimensional weaving process, a contour warp knitting or net-type weft knitting process, and the like.

In the case in which the non-conductive member is the porous non-conductive member based on fibers, the non-conductive member may have an apparent porosity of 20 to 80%, specifically, 30 to 70%, but is not limited thereto. Further, an average size of pores may be 100 to 2000 nm, specifically, 200 to 1000 nm, but is not limited thereto.

In the case in which the non-conductive member is the porous web, as a specific example, the thread, the woven fabric, or the non-woven fabric, based on fibers, a porosity of the non-conductive member may be constant in a lamination direction (a direction perpendicular to the length direction of the wick or a thickness direction of the non-conductive member). Unlike this, the porosity of the non-conductive member may be continuously or discontinuously changed in the stacking direction.

As a specific example, the non-conductive member may be a laminate in which two or more porous webs (porous webs based on fibers) having apparent porosities different from each other are laminated. In the case in which the non-conductive member includes two or more porous webs having apparent porosities different from each other, mechanical properties of the wick may be improved through a porous web having a relatively low porosity, and an effective heat transfer barrier may be formed through a porous web having a relatively high porosity. Further, if necessary, it is possible to stably supply the fuel through a porous web having a more advantageous porosity for supplying the fuel in a direction toward the upper end of wick by capillary force.

The porous web may have an apparent porosity of 20 to 80%, specifically, 30 to 70%, and in the case in which the non-conductive member includes two or more porous webs having apparent porosities different from each other, a difference in porosity between the porous webs may be 10 to 60%, but is not limited thereto. In the case in which the non-conductive member includes two or more porous webs having apparent porosities different from each other, two or more porous webs may be laminated so that the porosity is sequentially decreased from a porous web contacting the conductive member to a porous web opposite thereto. Unlike this, two or more porous webs may be laminated so that the porosity is sequentially increased from the porous web contacting the conductive member to the porous web opposite thereto.

However, according to the exemplary embodiment of the present invention, the non-conductive member is not limited to the above-mentioned porous non-conductive member or the above-mentioned non-porous non-conductive member. As an example, the non-conductive member may include a structure in which the above-mentioned porous non-conductive member and the above-mentioned non-porous non-conductive member are laminated.

Hereinafter, a coupling structure of the above-mentioned conductive member and the above-mentioned non-conductive member will be described in detail.

According to an exemplary embodiment of the present invention, a wick may include one or more conductive members; and one or more non-conductive members coupled to the conductive member. Here, the coupling of the conductive member and the non-conductive member may include a case in which the conductive member and the non-conductive member are simply physically close to each other or a case in which the conductive member and the non-conductive member are adhered to each other to thereby be integrated with each other by a binding agent. Further, in the case in which the conductive member and the non-conductive member are adhered to each other to thereby be integrated with each other by the binding agent, the binding agent may be an ingredient similar or equal to the above-mentioned binder.

As described above, the conductive member and the non-conductive member may each independently have a plate shape, a strip shape, a flat plate strip shape, a wire shape, a bar shape, a hollow pillar shape, or the like. In the case in which the non-conductive member has the hollow pillar shape, the conductive member may have a hollow pillar shape in which it is positioned outside the non-conductive member and forms a concentric structure with the non-conductive member. Further, unlike this, in the case in which the non-conductive member has the hollow pillar shape, the conductive member may have a hollow pillar shape in which it is positioned inside the non-conductive member and forms a concentric structure with the non-conductive member, or a bar (pillar) shape in which the conductive member fills an internal empty space of the non-conductive member. In the case in which the conductive member and the non-conductive member each independently have the plate shape, the strip shape, the flat plate strip shape, the wire shape, or the bar shape, side surfaces of the conductive member and the non-conductive member in parallel with the length direction may contact each other. Widths (diameters or thicknesses) of the conductive member and the non-conductive member may be equal to or different from each other within the above-mentioned ranges. In detail, independently of the length of the conductive member, the non-conductive member may have a length of 1 to 50 cm, specifically 3 to 30 cm, and more specifically, 5 to 15 cm, but is not limited thereto. Independently of the conductive member, an average diameter or width of the non-conductive member may be 0.01 to 100 mm, specifically, 0.1 to 50 mm, and more specifically 0.5 to 20 mm, but is not limited thereto. However, in the case in which the lengths of the conductive member and the non-conductive member are not equal to each other (that is, the lengths are similar to each other), the conductive member may have a relatively long length than that of the non-conductive member, such that the conductive member may be positioned to protrude from an upper end portion of the non-conductive member. As an example, an upper end of the conductive member may be positioned to protrude from an upper end of the non-conductive member by about 0.1 to 3 cm. This protrusion structure may be more advantageous for an electric discharge of the wick.

FIG. 6 illustrates an example of a wick including a strip-shaped non-conductive member 40*a* coupled to a side surface of a strip-shaped conductive member 40*b* as an example of the wick including both the conductive member and the non-conductive member.

According to an exemplary embodiment of the present invention, a wick may have a shape in which one conductive member and one non-conductive member are coupled to each other as in FIG. 6. Unlike this, the wick may include two or more conductive members. In the case in which the wick includes two or more conductive members, the non-conductive member may be positioned between the conductive members.

As a more specific example, the wick may include at least two conductive members and the non-conductive member interposed between the conductive members facing each other. The non-conductive member interposed between the conductive members is porous, which is advantageous. The reason is that in the case in which the non-conductive member is porous, a fluid may smoothly move, and a discharge between the conductive members facing each other with the non-conductive member interposed therebetween may easily occur. In view of ease of the discharge, it is preferable that the porous non-conductive member is a non-conductive member having porosity by the through pore.

FIG. 7 illustrates an example of a wick including a flat plate strip-shaped non-conductive member 50*a* interposed between flat plate strip-shaped conductive members 50*b* and 50*c* facing each other. The non-conductive member 50*a* of the wick of FIG. 7 may include through pores 50*f* and 50*f*′(2) penetrating therethrough in a direction from the conductive member 50*b* to the conductive member 50*c*. The wick illustrated in FIG. 7 has a structure in which a smooth discharge between the conductive members 50*b* and 50*c* facing each other may be secured by the through pores and the discharge more effectively occurs by a wide opposing area due to the flat plate strip shape of the conductive member, and of which physical stability is excellent due to the same shape of the conductive member and the non-conductive member. Here, as described above, a through pore 50*f* positioned adjacently to one end of the wick may be in a state in which an empty space is not filled with the combustible solid fuel but is maintained as it is, and the other through pores 50*f* (2) may be in a state in which they are filled with the combustible solid fuel.

According to an exemplary embodiment of the present invention, a wick may be a laminate in which one or more non-conductive members and one or more conductive members are alternately laminated, and the non-conductive member may be positioned at the outermost portion of the laminate. The non-conductive member is positioned at the outermost portion of the laminate, which means a shape in which the non-conductive member is positioned in at least one surface of the outermost portion of the laminate. As a specific example, the wick may include two non-conductive members and two conductive members, and include a laminate in which a first non-conductive member, a first conductive member, a second non-conductive member, and a second conductive member are laminated. As another specific example, the wick may include three non-conductive members and two conductive members, and include a laminate in which a first non-conductive member, a first conductive member, a second non-conductive member, a second conductive member, and a third non-conductive member are laminated. In this case, the non-conductive member positioned at the outermost portion may be a non-porous non-conductive member, and the wick may freely stand while bearing its own weight by the non-conductive member positioned at the outermost portion, which is advantageous. However, a non-conductive member interposed between conductive members facing each other is a non-conductive member having porosity by the through pore, which is advantageous.

An example of the wick according to the exemplary embodiment of the present invention is illustrated in FIG. 8. Referring to FIG. 8, the wick of FIG. 8 has a structure in which both a conductive member and a non-conductive member have a flat plate strip shape, and a first non-conductive member 50*d*, a first conductive member 50*b*, a second non-conductive member 50*a*, a second conductive member 50*c*, and a third non-conductive member 50*e* are laminated. The first and third non-conductive members 50*d* and 50*e* are positioned at outermost portions of the laminate, respectively. Here, the non-conductive member 50*a* of the wick of FIG. 8 may include through pores 50*f* penetrating therethrough in a direction from the conductive member 50*b* to the conductive member 50*c*, and the other through pores except for a through pore positioned adjacently to one end of the non-conductive member 50*a* may be in a state in which the through pore is filled with the fuel.

Further, based on one end of a laminate in which the conductive member and the non-conductive member are laminated, one end of the conductive member may be positioned to protrude from one end of the non-conductive member. That is, in a laminate in which a single conductive member and a single non-conductive member are laminated, one end of the conductive member may be positioned to protrude from one end of the non-conductive member. Further, in the case in which a non-conductive member is interposed between two conductive members as in the example illustrated in FIG. 8, one ends of at least two conductive members may be all positioned to protrude from one end of the non-conductive member positioned between the conductive members. That is, in the case in which the wick includes a laminate of the first conductive member 50*b*, the second non-conductive member 50*a*, and the second conductive member 50*c* as in the example illustrated in FIG. 8, the non-conductive member 50*a* positioned between two conductive members may be positioned inward based on one end of the laminate.

As described above, according to an exemplary embodiment of the present invention, a wick includes a conductive member and a non-conductive member and includes a structure in which the conductive member and the non-conductive members are coupled to each other through side surfaces thereof which are parallel with the length direction, but the wick is not limited thereto.

In detail, according to the exemplary embodiment of the present invention, the wick may include at least one conductive member and a non-conductive member, and may have a structure in which the conductive member is inserted into the non-conductive member. That is, the conductive member may be inserted into the non-conductive member so that surfaces of the conductive member parallel with the length direction are enclosed by the non-conductive member and both ends of the conductive members in the length direction are exposed to a surface of the wick. Further, the wick may include two or more conductive members inserted into the non-conductive member so as to be spaced apart from each other.

In the structure of the wick described above, in the case in which the wick includes two or more conductive members, a spaced distance between the conductive members may be 0.1 to 50 mm, specifically, 1 to 20 mm. This spaced distance is advantageous in that a discharge may smoothly occur at a low voltage.

According to an exemplary embodiment of the present invention, a wick may be a bar shape, but is not limited thereto. As an example, the wick may have a plate shape, a bar shape, and the like. Examples of the wick according to the exemplary embodiment of the present invention are illustrated in FIGS. 9 and 10. Referring to FIG. 9, an example of a wick in which strip-shaped conductive members 60*b* and 60*c* are inserted into a bar-shaped non-conductive member 60*a* so as to be spaced apart from each other is illustrated in FIG. 9. Here, as in the example illustrated in FIG. 9, one ends of the conductive members 60*b* and 60*c*, or both ends thereof may protrude to the outside of the non-conductive member 60*a* for a smooth initial discharge, such that the conductive members are exposed to a surface of the wick. Further, an example of a wick in which two conductive members 70*b* and 70*c* having a wire shape are inserted into a plate-shaped non-conductive member 70*a* so as to be spaced part from each other. Here, similarly to the wick of FIG. 9, the wick of FIG. 10 may also protrude to the outside of an upper end portion of the non-conductive member.

As described with reference to FIGS. 1 to 10, the wick may be a wick composed of the conductive member, the wick including the non-conductive member coupled to the conductive member, the wick in which the non-conductive member is interposed between two or more conductive members, the wick in which the non-conductive member and the conductive member are alternately laminated, or the wick in which at least one conductive member is inserted into the non-conductive member.

As a specific example, the wick may include a laminate selected from the following i) to vi):

i) a laminate of the conductive member and a non-porous non-conductive member, ii) a laminate of the conductive member and a porous non-conductive member, iii) a laminate of a first conductive member, a porous non-conductive member, and a second conductive member iv) a laminate of a first conductive member, a non-porous non-conductive member, and a second conductive member, v) a laminate of a non-porous first non-conductive member, a first conductive member, a porous second non-conductive member, and a second conductive member, vi) a laminate of a non-porous first non-conductive member, a first conductive member, a porous second non-conductive member, a second conductive member, and a non-porous third non-conductive member.

Here, the laminate itself selected from i) to vi) may be in a state in which it is coated with combustible solid fuel. Unlike this, the laminate may be in a state in which the conductive member, the non-conductive member, or the conductive member and the non-conductive member forming the laminate selected from i) to vi) are coated with the combustible solid fuel.

Further, in the laminate selected from i) to vi), the conductive members included in each laminate or one laminate may each independently have the following a) to d) structures, respectively:

a) a structure including a porous non-conductive matrix and a conductive unit dispersedly coupled to the inside of the non-conductive matrix or a surface of the non-conductive matrix, b) a structure including a dense non-conductive matrix and a conductive unit dispersedly coupled to the inside of the non-conductive matrix or a surface of the non-conductive matrix, c) a network of a conductive unit d) foam, a film, a mesh, felt, a wire, or a perforated film of one or two or more conductive materials selected from a conductive carbon material, a conductive polymer, and a metal, or a laminate thereof.

Further, in the case in which the wick includes a laminate in which a first conductive member, a non-conductive member, and a second conductive member are sequentially laminated as in the laminate of iii), v), or vi), the non-conductive member interposed between two conductive members is a porous non-conductive member, which is advantageous for generating a discharge. The porous non-conductive member as described above may include a non-conductive member in which a through pore is formed.

Further, it is advantageous that pores of the porous non-conductive member interposed between two conductive members are filled with combustible solid fuel so as to generate a selective discharge at one end of the wick. In detail, when a region of the wick dipped in the fuel of the candle which is fuel used at the time of combustion of the wick is defined as a dipping region, and a region of the wick protruding outside of the fuel of the candle is defined as a protrusion region, it is advantageous that a pore of the non-conductive member positioned in the dipping region of the porous non-conductive member interposed between two conductive members is filled with combustible solid fuel. That is, the pore of the porous non-conductive member interposed between two conductive members is filled with the combustible solid fuel, but a pore included in the protrusion region may not be filled with combustible fuel.

Further, in the case in which the wick includes a laminate in which a first conductive member, a (porous or non-porous) non-conductive member, and a second conductive member are sequentially laminated as in the laminate of iii), iv), v), or vi), the non-conductive member positioned between two conductive members may be positioned inward based on one end of the laminate. In detail, when a region of the wick dipped in the fuel of the candle which is fuel used at the time of combustion of the wick is defined as a dipping region, and a region of the wick protruding outside of the fuel of the candle is defined as a protrusion region, in the protrusion region, one end of the non-conductive member interposed between two conductive members may be positioned between one end of the conductive member and a surface of fuel of the candle. This structure is advantageous for an initial discharge in that surfaces of two conductive members may directly face each other.

The wick has conductivity at least in the length direction of the wick by the conductive material, specifically, the conductive member, a discharge may occur between one ends of two conductive members spaced apart from each other and facing each other or two wicks spaced apart from each other and facing each other by an electric signal. Here, in order to allow the wick to be ignited by the discharge, it is advantageous that fuel exists in a discharge region in which the discharge occurs. On the other hand, in order to generate a discharge, a structure in which one end of the wick protrudes outside the fuel is advantageous. Therefore, the wick may be coated with fuel of a candle so that a desired discharge may easily and reproducibly occur and a flame may be formed by the discharge.

That is, the wick of the auto-ignition unit according to the exemplary embodiment of the present invention may be coated with fuel. Here, the wick coated with the fuel may mean a wick including a conductive member coated with the fuel, a wick including a non-conductive member coated with the fuel, or a wick including both the conductive member coated with the fuel and the non-conductive member coated with the fuel.

As the fuel coated on the wick, any combustible solid fuel may be used as long as it is generally used as fuel of a candle. Further, the fuel coated on the wick may be a material equal to or different from fuel for a candle used as fuel at the time of igniting a candle in an auto-ignition candle to be described below. As a specific example, the fuel coated on the wick may be wax, wherein the wax may be any one or a mixture of two or more selected from paraffin wax, bees wax, soy wax, palm wax, gel wax, and the like, but is not limited thereto. As a coating method, any one method selected from a dip coating method of dipping the wick (the conductive member and/or the non-conductive member) in melted wax, a dry coating method, a laminating method, a spray method, and the like, may be used. However, any coating method may be used without limitation as long as it is known in the art. It is advantageous that the fuel is coated in an amount at which a flame may be stably and reproducibly formed in the wick by ignition at the time of a discharge, and when the wick (the conductive member and/or the non-conductive member) is porous, porosity thereof is not impaired. As a specific example, 0.1 to 20 parts by weight, specifically, 0.5 to 10 parts by weight of the fuel may be coated based on a weight (100 parts by weight) of the wick (the conductive member when the conductive member is coated, and the non-conductive member when the non-conductive member is coated as a coating target) before coating, but the present invention is not limited thereto.

Further, the case in which the non-conductive member is made of solid fuel different from fuel of the candle, regardless of whether or not the wick is coated with the fuel, and particularly, the case in which the non-conductive member is made of solid fuel different from fuel of a candle in a structure of the wick in which the non-conductive member is interposed between two conductive members, which may be advantageous for ignition in that it is possible to supply the fuel to a discharge region at which a discharge occurs at the time of the discharge.

The auto-ignition unit for a candle according to the exemplary embodiment of the present invention may include a single wick, and unlike this, the auto-ignition unit for a candle may include two or more wicks positioned to be physically spaced apart from each other.

In the case in which the auto-ignition unit for a candle includes a single wick, the single wick may include at least two conductive members. In detail, the single wick may include two conductive members facing each other with a non-conductive member interposed therebetween.

In the case in which the auto-ignition unit for a candle includes two or more wicks, each of the wicks may be positioned to be spaced apart from each other and face each other. In the case in which the auto-ignition unit for a candle includes two or more wicks, each of the respective wicks may have any wick structure described above. That is, the wicks may be each independently one or two or more selected from the wick composed of the conductive member, the wick including the non-conductive member coupled to the conductive member, the wick in which the non-conductive member is interposed between two or more conductive members, the wick in which the non-conductive member and the conductive member are alternately laminated, and the wick in which at least one conductive member is inserted into the non-conductive member so as to be spaced apart from each other. In the case in which the auto-ignition unit for a candle includes two or more wicks and each of the wicks includes both the conductive member and the non-conductive member, two wicks may be positioned to be spaced apart from each other so that the conductive members of the respective wicks face each other. As a specific and non-restrictive example, the wick may include a conductive member and a non-porous non-conductive member such as a flat plate strip-shaped wood coupled to the conductive member, and two wicks are positioned to be spaced apart from each other so that the conductive members of two wicks face each other.

Further, in the case of a spaced distance of two or more wicks, a spaced distance between upper end portions of the wicks may be equal to, shorter than, or longer than a spaced distance between lower end portions of the wicks. In detail, the spaced distance between the upper end portions of the wicks is equal to the spaced distance between lower end portions of the wicks, which is advantageous in that a discharge may easily occur at a low voltage even in the case of repetitively using the candle. As an example, the spaced distance between the wicks may be 0.1 to 50 mm, specifically 1 to 20 mm.

The auto-ignition unit for a candle according to the exemplary embodiment of the present invention may further include an electrode positioned at a lower end portion of the wick and electrically connected to the conductive member of the wick. Here, in the case of the single wick, two or more conductive members provided in the wick may be connected to positive and negative electrodes, respectively, and in the case of two or more wicks, the conductive members of the respective wicks may be connected to positive and negative electrodes, respectively. In the electrode, any electrode material may be used as long as it is generally used. As an example, the electrode may be a metal electrode. An example of the metal electrode may include electrodes made of one or two or more selected from iron, stainless steel, copper, aluminum, silver, gold, and the like, but is not limited thereto. The electrode may be in a state in which the electrode is electrically insulated by an insulator except for a region thereof connected to the conductive member or a region electrically connected to other components such as an ignition unit to be described below, or the like. This case is more advantageous in that it is possible to basically prevent a discharge from directly occurring in the electrode.

In addition, the electrode may further include a connector for connecting the wick. The connector may have a shape of a groove or clip capable of fixing the wick, or a plate capable of contacting a wick clip made of a metal material and fixing the wick to fix the wick, but is not limited thereto. The wick is connected to the electrode in a shape in which the wick is fixed by the connector, such that a current may flow.

According to the exemplary embodiment of the present invention, the number of two or more wicks spaced apart from each other may be even or odd. In the case in which the number of wicks is even, even-numbered wicks connected to electrodes having different polarities may be adjacently spaced apart from each other. In the case in which the number of wicks is odd, the wick may include a wick that is not connected to an electrode, in addition to even-numbered wicks connected to electrodes having different polarities. Here, the wick that is not connected to the electrode may be positioned between the wicks connected to the electrodes and spaced apart from each other.

Perspective diagrams and cross-sectional diagrams of structures including two or more wicks according to the exemplary embodiments of the present invention are illustrated in FIGS. 11 to 16. FIG. 11 illustrates a perspective diagram of an auto-ignition unit for a candle including two wicks. FIG. 12 illustrates a perspective diagram of an auto-ignition unit for a candle including three wicks. FIG. 13 illustrates a perspective diagram of an auto-ignition unit for a candle including four wicks, and FIG. 14 illustrates a cross-sectional diagram thereof. FIG. 15 illustrates a perspective diagram of an auto-ignition unit for a candle including five wicks, and FIG. 16 illustrates a cross-sectional diagram thereof. The number of wicks and the position of the electrode in FIGS. 11 to 16 are illustrated by way of examples, and are not limited thereto.

As a specific example, in the case in which the auto-ignition unit for a candle includes two wicks, one wick 10*a* of two wicks positioned to be spaced apart from each other may be connected to a positive electrode 20, and the other wick 10*b* may be connected to a negative electrode 30. The wicks 10*a* and 10*b* may face each other. In the case in which the auto-ignition unit for a candle includes three wicks, a wick 10*c* that is not connected to a positive or negative electrode may be positioned between two wicks 10*a* and 10*b* spaced apart from each other and connected to a positive or negative electrode, respectively. Here, the wick 10*c* that is not connected to the electrode is positioned between two wicks 10*a* and 10*b* generating the discharge, such that the wick 10*c* may be automatically ignited at the time of discharge. In the case in which the auto-ignition unit for a candle includes four wicks, wicks 10*a* and 10*c* spaced apart from each other may be connected to a positive electrode 20, respectively, and wicks 10*b* and 10*e* spaced apart from each other may be connected to a negative electrode 30, respectively. In the case in which the auto-ignition unit for a candle includes five wicks, a wick 10*c* that is not connected to a positive or negative electrode may be positioned at the center of four wicks spaced apart from each other and facing each other.

The auto-ignition unit for a candle according to the exemplary embodiment of the present invention may further include an ignition means applying a voltage to the electrode. According to the present invention, the ignition means applies a voltage to the conductive member of the wick through the electrode, thereby making it possible to cause one or more discharges selected from an arc discharge, a flame discharge, a corona discharge, and a glow discharge. In more detail, the ignition means may receive a predetermined voltage from a power supply unit and boost the received voltage to a discharge voltage (preset voltage value) to output the discharge voltage. Therefore, the ignition means may include a general transformer. In addition, the ignition means may include a high frequency generating circuit generating the discharge voltage at a high frequency (several kHz to several MHz order) for effective discharge. However, the present invention is not limited by a specific configuration of the ignition means, and as the ignition means, any electric device or circuit capable of receiving an AC or DC power to output a discharge voltage corresponding to a preset voltage (several kV to several hundreds kV levels) or output a high-frequency discharge voltage may be used.

According to the exemplary embodiment of the present invention, the discharge by the ignition means may include the arc discharge, and it is advantageous that the wick is automatically ignited by the arc discharge. Hereinafter, the present invention will be described in detail based on auto-ignition by the 'arc discharge'.

The arc discharge means that in the case of instantly applying a high voltage to positive and negative electrodes, which are electrodes, a potential difference is generated between the positive and negative electrodes, and a discharge occurs by the generated potential difference. According to the present invention, at the time of applying a high voltage from the ignition means, a discharge occurs in one end of the wick electrically connected to each of the electrodes, thereby forming a plasma flame. The auto-ignition unit for a candle may generate a flame in the wick of the candle using the plasma flame generated through the arc discharge in air.

To this end, the ignition means may be configured to include the positive and negative electrodes positioned at lower ends of wicks and connected to two or more wicks, respectively, as an arc generating circuit. Here, the wick, the electrode, and the ignition means may be electrically connected to each other. In detail, the ignition means may apply the voltage to the conductive member through each of the electrodes connected to the wick to generate a discharge in the wick (or between the wicks), such that the wick may be automatically ignited by the plasma flame through the discharge in air.

The auto-ignition unit for a candle according to the exemplary embodiment of the present invention may further include the power supply unit. Here, the power supply unit may supply power to the ignition means. The power supply unit supplies operation power to the ignition means, and a high frequency discharge voltage is output from the ignition means and applied to the wick, such that the discharge occurs in one end of the wick, and the wick may be ignited.

According to the exemplary embodiment of the present invention, the power supply unit may be a wired power supply unit or wireless power supply unit. The power supply unit may be connected to an external power supply through a wire, or operation power may be supplied to the candle through a battery, which is a wireless power supply unit. In the case in which the power supply unit is connected through the wire, it is preferable that the power supply unit is in a form of a circuit transferring power supplied from the outside as it is.

As a specific example, the wired power supply unit includes a power connector to thereby receive electricity through a plug, a universal serial bus (USB) cable, or the like, but is not limited thereto. The battery may be a primary battery or secondary battery, but is not limited thereto. The primary battery may be any one or more selected from a manganese battery, an alkaline battery, and the like, and the secondary battery may be any one or more selected from a lithium ion battery, a lithium polymer battery, a lithium air battery, and the like, but the primary and secondary batteries are not limited thereto. In the case in which the power supply unit is in a form of the battery, it is preferable that a shielding plate is positioned between the power supply unit and the electrode to thereby protect the power supply unit from the flame itself or heat from the flame. The battery of the power supply unit may be connected to a charging cable through a connector to thereby be charged, or may further include a wireless charging circuit to thereby be charged without a wire.

According to the exemplary embodiment of the present invention, the power supply unit may further include a switch capable of electrically connecting or blocking operation power. As a specific example, the switch may be any one or more selected from a single pole, single throw (SPST) switch, a single pole, double throw (SPDT) switch, a double pole, single throw (DPST) switch and a double pole, double throw (DPDT) switch, but is not limited thereto.

According to the exemplary embodiment of the present invention, the auto-ignition unit may further include a sensor for sensing a temperature, gas, heat, or light. Here, the gas may include gas generated at the time of using the candle, and as a substantial example, the gas may include carbon dioxide, or the like. As a specific example, the sensor may be one or two or more selected from a thermocouple, a metal thermometer, a thermistor, an integrated circuit (IC) temperature sensor, a magnetic temperature sensor, a thermopile, a power saving temperature sensor, a carbon dioxide sensor, a ultraviolet (UV) sensor, an infrared (IR) sensor, a visible light sensor, and the like, but is not limited thereto. Here, the sensor may be provided at any position at which the temperature, gas, heat, or light generated in the wick ignited by the discharge may be easily sensed. As an example, the sensor may be positioned on an upper end of a case enclosing the fuel of the candle, or attached to the electrode at a lower end of the wick or the case, but is not limited thereto.

According to the exemplary embodiment of the present invention, the auto-ignition unit for a candle may further include a communication unit receiving or transmitting and receiving information on an operation of the auto-ignition unit as an electric signal through wired or wireless communications. Here, the wireless communication may include near field communication such as Wi-Fi, Bluetooth, infrared (IR) communication, and the like, but is not limited thereto. The communication unit may receive a control command (including a signal indicating ignition) associated with an operation of the auto-ignition unit. Further, the communication unit may transmit a state (including a change in state) of the candle according to the received control command such as whether or not a discharge occurs, whether or not the wick is normally ignited by the discharge, and the like, to a terminal of a user. As the communication unit, a general transmitting and receiving device used for receiving data or communication in an established wired/wireless communication network may be used. As a specific example, the communication unit may include an antenna receiving or transmitting an electric signal, a transcoding device, or a protocol processor processing data according to a communication protocol, but the present invention is not limited thereto. The terminal transmitting an electric signal including the control command to the communication unit and receiving an electric signal transmitted from the communication unit as needed may be a personal wired/wireless terminal including a remote control, a mobile phone, a notebook, and the like, but is not limited thereto.

The auto-ignition unit for a candle may include a control unit together with the communication unit. That is, the auto-ignition unit for a candle may include the communication unit receiving or transmitting and receiving the electric signal and the control unit controlling the ignition means by the electric signal received from the communication unit.

In detail, the control unit may control the ignition means. More specifically, the control unit may control whether or not the ignition means operates (whether or not the discharge voltage is outputted), output conditions such as a level or frequency of the voltage outputted from the ignition means, an output time, and the like, whether or not power is supplied from the power supply unit to another component, and the like.

In the case in which the control command including an ignition command, or the like, is generated in the terminal of the user, the auto-ignition unit receives the control command through the communication unit, and the control unit may control whether or not the voltage is applied from the power supply unit to the ignition means, whether or not the ignition means is operated (whether or not the discharge voltage is outputted), an operation time of the ignition means, a level or frequency of an output voltage, and the like according to the received control command. Further, the control unit may receive a value measured from the sensor to transmit a state (or a change in state) of the candle, or the like, to the terminal of the user.

A block diagram of the auto-ignition unit for a candle according to the exemplary embodiment of the present invention is illustrated in FIG. 17. Describing with reference to FIG. 17, FIG. illustrates a block diagram of the auto-ignition unit for a candle in which the wick, the electrode, and the ignition means are electrically connected to each other, the power supply unit, the switch, and the sensor are included, and the control part, the communication unit, and a charge unit are optionally included.

The auto-ignition unit for a candle according to the exemplary embodiment of the present invention may further include an upper case having a housing shape in which an upper portion thereof is opened, and accommodating liquid or solid fuel and the wick therein; and a lower case positioned below the upper case, accommodating the above-mentioned ignition means and power supply unit therein, and coupled to the upper case.

Although not limited, at least upper case may be made of a heat resistant material, particularly, heat resistant transparent material. As a specific example, the upper case may be made of heat resistant glass, high-heat resistant glass, or the like, but is not limited thereto. Here, the wick may be positioned at the center of the inside of the upper case. Further, a bottom surface of the upper case may be provided with the electrode connected to the wick while penetrating through the bottom surface. However, the upper case may have a structure in which the wick penetrates through the bottom surface of the upper case and one end of the wick adjacent to the bottom surface is electrically connected to the electrode, and electrical connection between the wick and the electrode may automatically occur at the time of coupling the upper and lower cases to each other. The coupling between the upper and lower cases is not particularly limited, but may include screw-coupling, or the like. Further, the communication unit and the control unit may be further accommodated in the lower case.

The present invention includes an auto-ignition candle including the above-mentioned auto-ignition unit for a candle.

In detail, an auto-ignition candle according to an exemplary embodiment of the present invention may include the above-mentioned auto-ignition unit and fuel provided to contact the wick of the auto-ignition unit. Here, the term "provided to contact" may mean that the fuel encloses at least a portion of the wick in the length direction of the wick.

A position of the wick is not particularly limited, but it is preferable that the wick is positioned at the center of the fuel. In the case in which the wick is positioned at the center of the fuel, at the time of combustion of the candle, a flame of the wick may uniformly melt the fuel, which is preferable. The fuel of the candle may be raised by a capillary phenomenon of the wick, thereby maintaining combustion of the wick. Further, one of both ends of the wick, positioned adjacent to at least surface (upper end) of the fuel may be in a state in which it protrudes outside the fuel, and in the case in which the auto-ignition candle includes two or more wicks, two or wicks may be in a state in which all of them protrude outside the fuel. As a more substantial example, the wick may have a structure in which the wick penetrates through the fuel, at least one of both ends thereof protrudes outside the fuel, and the other is electrically connected to the electrode.

The auto-ignition candle according to an exemplary embodiment of the present invention may include an upper case having a housing shape in which an upper portion thereof is opened, and accommodating fuel and the wick therein; a liquid or solid fuel accommodated in the upper case; a wick partially dipped in the fuel so as to protrude one end thereof; an electrode provided on a bottom surface of the upper case and electrically connected to the other end of the wick; and a lower case positioned below the upper case and coupled to the upper case, accommodating an ignition means and a power supply unit therein, wherein the ignition means applies a discharge voltage to the wick through the electrode and the power supply unit supplies power to the ignition means.

The electrode provided on the bottom surface may be provided on an outer surface of the bottom surface facing the lower case, and the wick may penetrate through the bottom surface to thereby be connected to the electrode. Unlike this, the auto-ignition candle may have a shape in which the electrode is positioned to penetrate through the bottom surface, and the wick is connected to the electrode penetrating through the bottom surface of the upper case. However, the present invention is not limited by a specific position or structure of the electrode provided in the upper case. Further, a switch capable of electrically connecting or blocking operation power of the power supply unit may be further provided in the lower case, and other components such as the communication unit and the control unit, except for the wick (the wick and selectively a sensor) configuring the above-mentioned auto-ignition unit may be accommodated in the lower case.

The ignition means accommodated in the lower case may be electrically connected to the electrode, but have a structure in which the ignition means is directly connected to the electrode through an electric wiring. Alternatively, the ignition means may include a connection means detached from or attached to an electric wiring to thereby have a connection structure in which at the time of attachment (coupling) of the connection means, electric conduction may be made between the electrode (wick) and the ignition means, and at the time of detachment of the connection means, the electrode (wick) and the ignition means may be electrically and physically separated from each other. An example of the connection means as described above may include a plug, a jack, or the like, but is not limited thereto.

An auto-ignition candle according to an exemplary embodiment of the present invention may include a fuel part including solid fuel, a wick penetrating through the solid fuel so as to protrude one end thereof, and an electrode connected to the other end of the wick, and a body accommodating an ignition means, a control unit, and a power supply unit therein, and having an upper surface on which the fuel part is seated, wherein a connection terminal is formed at a position corresponding to the electrode of the seated fuel part on the upper surface of the body on which the fuel part is seated. When the fuel part is seated on the upper surface of the body, the connection terminal may contact the electrode of the seated fuel part, thereby forming a electrical connection path between the ignition means and the wick.

This means that at the time of using the candle, consumable components (the fuel, the wick, and the like) and inconsumable components may be physically detached from and attached to each other, and thus, the consumable components may be significantly easily and conveniently replaced.

As described above, the fuel part may be detached from and attached to the body, and the fuel part may be attached to the body by mechanical coupling or magnetic force.

As an example, in order to secure stable electric connection between the electrode of the fuel part and the connection terminal, the fuel part may include a first coupling member positioned at an end of the fuel (hereinafter, a lower end of the fuel) in which the other end of the wick connected to the electrode is positioned, and the body may include a second coupling member formed integrally with the body at a region on which the fuel part is seated, and coupled to the first coupling member.

As a specific example, in the case of screw coupling, the first coupling member may be a hollow cylindrical cap enclosing the lower end of the fuel and having and outer circumferential surface on which a screw thread is formed, and the second coupling member may be a hollow cylindrical protrusion portion (since the second coupling member is integrated with the body, the hollow cylindrical protrusion portion will be referred to as a protrusion portion of the upper surface) having an inner circumferential surface on which a screw thread corresponding to the screw thread of the first coupling member is formed. The fuel part may be physically fixed to the body by screw coupling between the first and second coupling members by rotation, and at the same time, the electrode of the fuel part may contact the connection terminal of the body. Although a case in which the first and second coupling members are screw-coupled by rotation is described by way of example, the first and second coupling members may be coupled to each other by any coupling method as long as the fuel may be physically stably fixed to the body. That is, the fuel part and the body may be coupled to each other using a known coupling structure depending on a coupling method.

As another example of the coupling, the fuel part and the body may be attached to each other by magnetic force. In detail, a permanent magnet may be provided in the fuel part and/or the region of the body on which the fuel part is seated, and the fuel part may be fixed to the body by magnetic attraction. In detail, the electrode of the fuel part electrically connected to the other end of the wick may be made of a conductive material, particularly, a ferromagnetic material or a paramagnetic material. In detail, an example of a magnetic electrode having conductivity may include a stainless steel electrode, an iron electrode, or the like, but is not limited thereto. Unlike this, a magnet may be further provided in the fuel part itself, such that the fuel part may further include a magnet positioned at the lower end of the fuel. The body may further include a magnet provided in the region on which the fuel part is seated, independently of the fuel part. More specifically, the magnet provided in the body may be positioned to contact the upper surface of the body so that the fuel part is fixed at a preset position of the upper surface of the body by magnetic attraction. In addition, the magnet may also be positioned below the connection terminal so that the electrode of the fuel part and the connection terminal of the body may be automatically connected to each other simultaneously with fixation of the fuel part.

In the example described above, a switch capable of electrically connecting or blocking operation power of the power supply unit may be further provided in the body, and other components such as the communication unit except for the wick (the wick and selectively a sensor) configuring the above-mentioned auto-ignition unit may be accommodated in the body. Further, the candle may further include a transparent case enclosing a circumference of the fuel part seated on the body while being spaced apart from the circumference, in addition to the fuel part and the body described above.

The fuel (hereinafter, the fuel of the candle) used in combustion of the wick may be solid fuel or liquid fuel. Here, the fuel may have a shape in which the fuel encloses the wick of the candle. A position of the wick is not particularly limited, but it is preferable that the wick is positioned at the center of the fuel. In the case in which the wick is positioned at the center of the fuel, at the time of combustion of the candle, a flame of the wick may uniformly melt the fuel, which is preferable. The fuel of the candle may be raised by a capillary phenomenon of the wick, thereby maintaining combustion of the wick.

As a specific example, the fuel of the candle may be any one or a mixture of two or more selected from paraffin wax, paraffin oil, bees wax, soy wax, palm wax, gel wax, and the like, but is not limited thereto.

According to the exemplary embodiment of the present invention, the fuel of the candle may further contain one or two or more additives selected from perfumes and dyes. It is preferable that the perfume and the dye are not harmful to the human body.

A specific example of the perfume may include fragrance oil corresponding to artificial perfume and/or natural essential oil extracted from plant, but is not limited thereto. As a more specific example, the perfume may be one or two or more selected from perfumes of lavender, rosemary, jasmine, chamomile, rose, geranium, lily, daisy, lemon, cinnamon, eucalyptus, bergamot, peach, and the like.

As a specific example, the perfume may be contained in a content of 0.1 to 10 parts by weight, preferably, 1 to 5 parts by weight, based on 100 parts by weight of the candle (the fuel of the candle), but is not limited thereto. The content of the perfume is in the above-mentioned range, which is preferable in that the candle may emit subtle fragrance at the time of combustion.

The dye is not particularly limited, but a dye having a suitable color may be selected depending on the object. As an example, the dye is a dye for a candle that is not harmful. As a specific example, the dye may have one or two or more colors selected from red, yellow, green, orange, purple, pink, brown, and the like.

As a specific example, the dye may be contained in a content of 0.1 to 10 parts by weight, preferably, 1 to 5 parts by weight, based on 100 parts by weight of the candle (the fuel of the candle), but is not limited thereto. The content of the dye is within the above-mentioned range, which is preferable in that a color of the candle may be exhibited.

According to the exemplary embodiment of the present invention, the candle (the fuel of the candle) may have various sizes and shapes depending on the object, and is not particularly limited. As a specific example, the candle (the fuel of the candle) may have one or two or more selected from a cylindrical shape, a tetragonal shape, a triangular shape, a pentagonal shape, a hexagonal shape, a heart shape, a star shape, and the like.

The present invention includes a candle II including solid fuel; a wick containing a conductive member while penetrating through the solid fuel so as to protrude one end thereof; and an electrode connected to the other end of the wick. The candle II as described above may correspond to the fuel part described above, and may be used together with the body described above to thereby be automatically ignited. Therefore, the wick of the candle II may be the same as or similar to the above-mentioned wick described based on the auto-ignition unit or the auto-ignition candle including the auto-ignition unit, and the candle II may further include the above-mentioned first coupling member of the fuel part and/or the magnet.

Hereinafter, the auto-ignition unit for a candle and the candle including the same according to the present invention will be described in more detail through Examples. However, the following Examples are only references for specifically explaining the present invention, but the present invention is not limited thereto and may be implemented in various forms.

Example 1

70 wt % of conductive activated carbon fiber having an average length of 3 mm and 30 wt % of wood pulp having an average length of 5 mm were mixed with each other. 20 parts by weight of an aqueous solution of 50 wt % of polyvinyl alcohol (Sigma-Aldrich, weight average molecular weight: 31,000 to 50,000 g/mol, 98 to 99% hydrolyzed, melting point: 200° C.) was added thereto and mixed therewith based on 100 parts by weight of the mixture, and cast on a flat plate having a mold, thereby manufacturing a sheet having a thickness of 0.3 mm. The manufactured sheet was dried at 25° C. for 36 hours. The dried sheet was cut at a size of 2 mm×7 cm (width×length), thereby manufacturing a conductive member.

After melting paraffin wax having a melting point of 61° C. by raising a temperature to the melting point, the manufactured conductive member was dipped in the melted solution of paraffin wax, thereby manufacturing a wick corresponding to the conductive member coated with paraffin wax. Here, at the time of dipping the conductive member, one end region of the conductive member to be connected to an electrode was not dipped in the paraffin wax.

Two wicks manufactured as described above were positioned in a heat resistant glass vessel having a bottom surface provided with a penetration electrode, and having a diameter of 7 cm and a height of 8.5 cm, the wicks were fixed using a clip-type electrode connector, and each of the wicks was electrically connected to the electrode of the bottom surface. Here, a spaced distance between two wicks was 5 mm. The electrode of the bottom surface of the vessel was connected to an ignition means applied with a voltage of 3.7V from a battery to output a high-frequency voltage of about 10 KV. The voltage outputted from the ignition means was applied to the wicks using a switch between the electrode and the ignition means.

After heating 200 g of paraffin wax having a melting point of 61° C. in a water bath, the melted paraffin wax was poured in the heat resistance glass vessel in which the wicks were positioned, and kept at 25° C. for 24 hours, thereby completely solidifying fuel for a candle. Thereafter, two wicks were cut so as to protrude from the fuel by 5 mm, thereby manufacturing an auto-ignition candle. A photograph of the candle manufactured in Example 1 is illustrated in FIG. 18.

Example 2

A conductive member was manufactured in the same manner as in Example 1, and pine wood processed at a size of 0.3 mm×2 mm×7 cm (thickness×width×length) was used as a non-conductive member. A single conductive member was laminated on a single non-conductive member, thereby manufacturing a laminate.

After melting paraffin wax having a melting point of 61° C. by raising a temperature to the melting point, the manufactured laminate was dipped in the melted solution of paraffin wax, thereby manufacturing a wick coated with the paraffin wax and including the conductive member and the non-conductive member coupled to each other. Here, at the time of dipping the laminate, one end region of the laminate to be connected to an electrode was not dipped in the paraffin wax.

Two wicks manufactured as described above were positioned in a heat resistant glass vessel having a bottom surface provided with a penetration electrode, and having a diameter of 7 cm and a height of 8.5 cm, the wicks were fixed using a clip-type electrode connector, and each of the wicks was electrically connected to the electrode of the bottom surface. Here, a spaced distance between two wicks was 3 mm. The electrode of the bottom surface of the vessel was connected to an ignition means applied with a voltage of 3.7V from a battery to output a high-frequency voltage of about 10 KV. The voltage outputted from the ignition means was applied to the wicks using a switch between the electrode and the ignition means.

After mixed fuel in which 80 wt % of paraffin wax having a melting point of 61° C. and 20 wt % of soy wax were mixed with each other was heated in a water bath, the melted mixed fuel was poured in the heat resistance glass vessel in which the wicks were positioned, and kept at 25° C. for 24 hours, thereby completely solidifying fuel for a candle. Thereafter, two wicks were cut so as to protrude from the fuel by 5 mm, thereby manufacturing an auto-ignition candle. A photograph of the candle manufactured in Example 2 is illustrated in FIG. 19.

Example 3

A candle was manufactured through the same processes as in Example 1 except for cutting a mesh-type fabric (16×18 mesh) of conductive carbon fiber at a width of 0.5 mm to manufacture a conductive member.

Example 4

A sheet was manufactured in the same manner as in Example 1 but cut to have a size of 2 mm×10 cm (width×length) to thereby be used as a conductive member, and cypress wood processed at a size of 0.3 mm×2 mm×7 cm (thickness×width×length) was used as a non-conductive member. As the wick, the conductive member and the non-conductive member were alternately laminated so as to have a structure in which the cypress wood, the conductive member, the cypress wood, the conductive member, and the cypress wood were laminated, similarly in FIG. 8.

Here, before lamination, the cypress wood interposed between the conductive members was punched, thereby forming a through pore. The through pore had a shape of a circle having a diameter of 1 mm, and the cypress wood was punched so that through pores were arranged to be spaced apart from each other by an interval of 2 mm in a length direction. After forming the through pore, paraffin wax having a melting point of 61° C. was melted by raising a temperature to the melting point. Then, the cypress wood (non-conductive member) in which the through pore was formed was dipped in the melted solution of the paraffin wax, thereby filling the through pore with the paraffin wax. Here, the through pore having a distance of 5 mm or less from one end of the cypress wood was not dipped in the melted solution of the paraffin wax, such that the pore in a region of one end portion was maintained intact.

Further, before lamination, two conductive members and the cypress wood (non-conductive member) positioned at the outermost position of the laminate were dipped in the melted paraffin wax to thereby be coated with the paraffin wax, respectively.

Thereafter, a wick was manufactured by sequentially laminating and coupling the cypress wood that was not punched but coated with the paraffin wax, the conductive member coated with the paraffin wax, the cypress wood punched and having the pores partially filled with the wax, the conductive member coated with the paraffin wax, and cypress wood that was not punched but coated with the paraffin wax.

At the time of lamination, polyvinylpyrrolidone was used as a binder resin, and the conductive member and the non-conductive member were stacked so that one end of the conductive member and one end of the non-conductive member were overlapped with each other at the same position, and the other end of the conductive member protruded from the laminate.

Thereafter, an auto-ignition candle was manufactured in the same manner as in Example 2 except for cutting one ends of two conductive members protruding from the manufactured wick at a suitable length instead of two wicks, and fixing the cut conductive members to a clip-type electrode connector, respectively. Here, the wick was in a state in which one end thereof protruded by 5 mm from the mixed fuel in which 80 wt % of paraffin wax and 20 wt % of soy wax were mixed with each other, and an end portion of the cypress wood in which the pore was not filed with the paraffin wax but maintained intact was positioned in a protruded end portion of the wick.

Example 5

Two zinc wires having a diameter of 0.5 mm, which were metal wicks, were used as conductive members, and inserted into a cotton fabric corresponding to a non-conductive member so as to be spaced apart from each other. Here, a spaced distance between the zinc wires was 5 mm. A wick (diameter: 1 cm) having a shape in which the zinc wire protruded by about 5 mm from an upper end of the wick and the cotton fabric enclosed the zinc wire was manufactured. An auto-ignition candle was manufactured in the same manner as in Example 1 except for using the manufactured wick, and fixing the zinc wires to an electrode connector, respectively.

Whether or not ignition was generated by a discharge was evaluated by applying a high-frequency voltage of 10 KV to the wick of each of the candles manufactured in Examples 1 to 5. A test was repeated three times, and an evaluation result was indicated by ○ or ×. ○ means a case in which a discharge occurred, a flame was formed by ignition, and the formed flame was maintained, and × means a case in which a flame was not formed by a discharge, or the formed flame was not maintained.

TABLE 1

| | Whether or Not Ignition Was Generated by Arc Discharge | | |
|---|---|---|---|
| | First | Second | Third |
| Example 1 | ○ | ○ | ○ |
| Example 2 | ○ | ○ | ○ |
| Example 3 | ○ | ○ | ○ |
| Example 4 | ○ | ○ | ○ |
| Example 5 | ○ | ○ | ○ |

Table 1 illustrates a result obtained by evaluating whether or not ignition was generated by an arc discharge in each of the samples. As illustrated in Table 1, It may be confirmed that in the candles in Examples 1 to 5, the flame was formed by all of the discharges, and the formed flame was stably maintained. Further, it was confirmed that as the candles in Examples 1 to 4 contained a conductive carbon material as the conductive member, formation of soot and ash was significantly decreased at the time of combustion, and it may be confirmed that particularly in Examples 1 to 3, soot and ash were rarely formed at the time of combustion.

Since the auto-ignition unit for a candle and the candle including the same according to the present invention are automatically ignited by the discharge, there are advantages in that uses thereof may be significantly convenient, the candle may be freely used even in a state in which there is no separate ignition device, and the user is free from risk of burns, or the like.

What is claimed is:

1. A candle comprising:

solid fuel;

at least one wick penetrating through the solid fuel so as to protrude one end thereof and containing a conductive material; and an electrode electrically connected to the other end of the at least one wick, wherein the conductive material is one or more selected from a conductive carbon material, a conductive polymer, and a metal, and the conductive material has one or more forms selected from a fiber, a particle, a tube, and a plate.

2. The candle of claim 1, wherein the at least one wick comprises two or more wicks spaced apart from each other.

3. The candle of claim 1, wherein the at least one wick includes a non-conductive matrix; and the conductive material dispersedly coupled to the non-conductive matrix.

4. The candle of claim 3, wherein the non-conductive matrix is porous.

5. The candle of claim 4, wherein the non-conductive matrix has one or two or more forms selected from a thread, woven fabric, and non-woven fabric of non-conductive fiber.

6. The candle of claim 1, wherein the at least one wick includes a conductive member containing the conductive material and a non-conductive member coupled to the conductive member.

7. The candle of claim 6, wherein the non-conductive member is porous.

8. The candle of claim 6, wherein the at least one wick includes two or more conductive members spaced apart from each other, and the non-conductive member is interposed between the conductive members.

9. The candle of claim 6, wherein in the at least one wick, two or more conductive members are inserted into the non-conductive member so as to be spaced apart from each other.

10. The candle of claim 6, wherein the non-conductive member is a supporter of the conductive member.

11. The candle of claim 6, wherein in the at least one wick, the non-conductive member and the conductive member are alternately laminated, but the non-conductive member is positioned at an outermost portion of a laminate.

12. The candle of claim 8, wherein the non-conductive member includes a through pore.

13. The candle of claim 12, wherein the at least one wick includes a dipping region dipped in the solid fuel and a protrusion region protruding outside of the solid fuel, and the through pore of the non-conductive member positioned in the dipping region is filled with combustible solid fuel.

14. The candle of claim 6, wherein the at least one wick includes a laminate in which a first conductive member, the non-conductive member, and a second conductive member are sequentially laminated, and the non-conductive member is positioned inward based on one end of the laminate.

15. The candle of claim 6, wherein the non-conductive member is one selected from woods, fibers, combustible solid fuel, and combination thereof, and the fibers are one selected from natural fiber, synthetic fiber or a thread, woven fabric, non-woven fabric of the natural fiber and synthetic fiber, and a combination thereof.

16. The candle of claim 6, wherein the at least one wick includes a laminate selected from the following i) to vi):

i) a laminate of the conductive member and a non-porous non-conductive member, ii) a laminate of the conductive member and a porous non-conductive member, iii) a laminate of a first conductive member, a porous non-conductive member, and a second conductive member iv) a laminate of a first conductive member, a non-porous non-conductive member, and a second conductive member, v) a laminate of a non-porous first non-conductive member, a first conductive member, a porous second non-conductive member, and a second conductive member, vi) a laminate of a non-porous first non-conductive member, a first conductive member, a porous second non-conductive member, a second conductive member, and a non-porous third non-conductive member.

17. The candle of claim 1, wherein the carbon material is one or two or more selected from carbon fiber, activated carbon, carbon nanotube, graphite, carbon black, graphene, reduced graphene oxide, and a carbon composite material, the conductive polymer is one or two or more selected from polyacetylene, polyaniline, polypyrrole, and polythiophene, and the metal has a melting temperature (Tm) of 150 to 500° C.

18. A candle comprising:

a solid fuel;

at least one wick penetrating through the solid fuel so as to protrude one end thereof and containing a conductive material; and an electrode electrically connected to the other end of the at least one wick to apply a voltage to the conductive material of the at least one wick at the time of lighting the candle, wherein the conductive material is one or more selected from a conductive carbon material, a conductive polymer, and a metal, and the at least one wick includes a conductive member and a non-conductive member coupled to the conductive member, the conductive member being foam, a film, a mesh, felt, a wire, or a perforated film of the conductive material.

19. The auto-ignition unit for a candle, comprising a wick containing a conductive material;

an electrode positioned at a lower end of the wick and electrically connected to the wick;

an ignition means receiving a power supply input to output a predetermined discharge voltage and applying the output discharge voltage to the electrode; and a power supply unit supplying power at least to the ignition means, wherein at the time of applying a discharge voltage to the electrode by the ignition means, a discharge occurs in the wick electrically connected to the electrode.

20. The auto-ignition unit for a candle of claim 19, further comprising:

a connector fixing the wick to the electrode.

21. The auto-ignition unit for a candle of claim 19, wherein the discharge is any one or more discharges selected from an arc discharge, a flame discharge, a corona discharge, and a glow discharge.

22. The auto-ignition unit for a candle of claim 19, wherein the power supply unit is a wired or wireless power supply unit.

23. The auto-ignition unit for a candle of claim 19, further comprising a sensor for sensing a temperature, gas, heat, or light.

24. The auto-ignition unit for a candle of claim 19, further comprising:

a communication unit receiving or transmitting and receiving an electric signal; and a control unit controlling the ignition means by the electric signal received from the communication unit.

25. The auto-ignition unit for a candle of claim 19, further comprising:

an upper case having a housing shape in which an upper portion thereof is opened, and accommodating liquid or solid fuel and the wick therein; and a lower case disposed below the upper case, accommodating the ignition means and the power supply unit, and coupled to the upper case, wherein a bottom surface of the upper case is provided with an electrode connected to the wick while penetrating through the bottom surface of the upper case.

26. An auto-ignition candle comprising the auto-ignition unit for a candle of claim 19.

27. The auto-ignition candle of claim 26, further comprising one or two or more fuels selected from paraffin wax, paraffin oil, soy wax, bees wax, palm wax, and gel wax.

28. The auto-ignition candle of claim 27, wherein the fuel contains one or two or more additives selected from perfumes and dyes.

29. The auto-ignition candle, comprising:

a fuel part including solid fuel;

a wick containing a conductive material and penetrating through the solid fuel so as to protrude one end thereof;

an electrode connected to the other end of the wick; and a body accommodating an ignition means and a power supply unit therein, and having an upper surface on which the fuel part is seated, the ignition means applying a voltage to the wick through the electrode, and the power supply unit supplying power to the ignition means.

30. The auto-ignition candle of claim 29, wherein the body further includes a communication unit receiving or transmitting and receiving an electric signal and a control unit controlling the ignition means by the electric signal received from the communication unit.

31. The auto-ignition candle of claim 29, wherein the fuel part is detached from and attached to the body by mechanical coupling or magnetic force.

32. The auto-ignition candle of claim 29, wherein a connection terminal is formed at a position corresponding to the electrode of the seated fuel part on the upper surface of the body.

33. An auto-ignition unit for a candle comprising a wick including a conductive member, wherein the conductive member includes a non-conductive matrix; and a conductive material dispersedly coupled to the non-conductive matrix, the conductive material is one or two or more selected from a conductive carbon material, a conductive polymer, and a metal, and has one or two or more forms selected from a fiber, a particle, a tube, and a plate, and the wick is ignited by a discharge.

34. The auto-ignition unit for a candle of claim 33, wherein the wick further includes a non-conductive member coupled to the conductive member.

35. The auto-ignition unit for a candle of claim 34, wherein the wick includes a laminate selected from the following i) to vi):

i) a laminate of a conductive member and a non-porous non-conductive member, ii) a laminate of a conductive member and a porous non-conductive member, iii) a laminate of a first conductive member, a porous non-conductive member, and a second conductive member iv) a laminate of a first conductive member, a non-porous non-conductive member, and a second conductive member, v) a laminate of a non-porous first non-conductive member, a first conductive member, a porous second non-conductive member, and a second conductive member, and vi) a laminate of a non-porous first non-conductive member, a first conductive member, a porous second non-conductive member, a second conductive member, and a non-porous third non-conductive member.

36. An ignition unit for a candle comprising a wick including a conductive member and a non-conductive member coupled to the conductive member, and an electrode positioned at a lower end of the wick and electrically connected to the wick to apply a voltage to the conductive material of the wick at the time of lighting the candle, wherein the conductive member being foam, a film, a mesh, felt, a wire, or a perforated film of the conductive material.

37. The ignition unit for a candle of claim 36, wherein the wick includes a laminate selected from the following i) to vi):

i) a laminate of a conductive member and a non-porous non-conductive member, ii) a laminate of a conductive member and a porous non-conductive member, iii) a laminate of a first conductive member, a porous non-conductive member, and a second conductive member iv) a laminate of a first conductive member, a non-porous non-conductive member, and a second conductive member, v) a laminate of a non-porous first non-conductive member, a first conductive member, a porous second non-conductive member, and a second conductive member, and vi) a laminate of a non-porous first non-conductive member, a first conductive member, a porous second non-conductive member, a second conductive member, and a non-porous third non-conductive member.

38. A candle comprising:

a solid fuel;

at least one wick penetrating through the solid fuel so as to protrude one end thereof and containing a conductive material; and an electrode electrically connected to the other end of the at least one wick to apply a voltage to the conductive material of the at least one wick at the time of lighting the candle.

* * * * *